US006033815A

United States Patent [19]

Taniguchi et al.

[11] Patent Number: 6,033,815

[45] Date of Patent: Mar. 7, 2000

[54] PHOTOSENSITIVE BODY FOR ELECTROPHOTOGRAPHICAL USE AND MANUFACTURING METHOD THEREOF

[75] Inventors: Hideaki Taniguchi, Yoshino-gun; Yasutaka Maeda, Soraku-gun; Masayuki Sakamoto, Nabari; Masaya Tsugoshi, Uda-gun; Makoto Kurokawa, Kitakatsuragi-gun, all of Japan

[73] Assignee: Sharp Kabushiki Kaisha, Osaka, Japan

[21] Appl. No.: 09/037,413

[22] Filed: Mar. 10, 1998

Related U.S. Application Data

[62] Division of application No. 08/608,157, Feb. 28, 1996, Pat. No. 5,773,175.

[30] Foreign Application Priority Data

Mar. 3, 1995 [JP] Japan ..... 7-44652
Oct. 5, 1995 [JP] Japan ..... 7-259053

[51] Int. Cl.[7] ..... G03G 15/00

[52] U.S. Cl. ..... 430/56; 156/242

[58] Field of Search ..... 430/56; 156/242

[56] References Cited

U.S. PATENT DOCUMENTS 5,328,790 7/1994 Asano et al. ..... 430/65
5,381,212 1/1995 Noguchi ..... 355/211

FOREIGN PATENT DOCUMENTS 0 200 468-A2 11/1986 European Pat. Off. .
0 579 189-A1 1/1994 European Pat. Off. .
0 600 256-A1 6/1994 European Pat. Off. .
3-259267 11/1991 Japan .
6-051551 2/1994 Japan .
6-149136 5/1994 Japan .

*Primary Examiner*—Mark Chapman
*Attorney, Agent, or Firm*—David G. Conlin; Richard E. Gamache; Dike, Bronstein, Roberts & Cushman, LLP

[57] ABSTRACT

A photosensitive body for electrophotographical use has a conductive base body and a marking area provided thereon. The maximum surface roughness of a photosensitive layer provided right on the marking area is specified not to exceed 2.5 μm. And also, a ratio of the optical reflective index of the marking area to the optical reflective index of the non-marking area is specified to be in a range of 0.3 to 0.7. In this manner, even when the photosensitive layer is thin (not exceeding 25 μm), it is possible to prevent problems such as inadequate cleaning and toner falling. Hence, it is possible to offer a photosensitive body for electrophotographical use which can constantly produce high quality copied images.

7 Claims, 7 Drawing Sheets

PHOTOSENSITIVE BODY FOR ELECTROPHOTOGRAPHICAL USE AND MANUFACTURING METHOD THEREOF

The present application is a division of U.S. Ser. No. 08/608,157, filed Feb. 28, 1996 now U.S. Pat. No. 5,773,175.

FIELD OF THE INVENTION

The present invention relates to a photosensitive body for electrophotographical use having a photosensitive layer provided on a conductive base body and a manufacturing method thereof, in particular, to a photosensitive body for electrophotographical use for optimizing copied image quality and a manufacturing method thereof.

BACKGROUND OF THE INVENTION

In order to obtain a copied image, an image forming process of an electrophotographical apparatus, such as a copying machine, generally begins with pressing a copying (image forming) start key and then follows a preprogrammed sequence: namely, driving a photosensitive body, charging the photosensitive body, forming a latent image by exposure, developing the image, feeding a sheet, transferring the image to the sheet, fixing the image to the sheet, cleaning the photosensitive body surface and eliminating residual potential of the photosensitive body.

In recent years, as there are market demands for improving copied image quality, image-forming process factors, such as (1) charged potential of the photosensitive body, (2) optical lamp voltage and (3) toner density, are controlled in order to obtain solid black and half-tone images of uniform density and high quality.

Here are some specific examples of factor controlling methods: (1) The charged potential is controlled by adjusting voltage applied by a charger on the basis of a difference between the charged potential measured by a surface electrometer and reference potential. (2) The optical lamp voltage is controlled by adjusting light source lamp voltage on the basis of a difference between post-exposure surface potential measured by a surface electrometer and reference potential. (3) The toner density is controlled by forming a toner image of uniform density patch on part of the photosensitive body and adjusting the toner-to-developer ratio on the basis of density of the toner image measured by an optical sensor.

In order to obtain a high quality copied image, each of these controlling methods controls a process factor by firstly forming an electrostatic latent image or a toner image on part of a photosensitive body surface, then measuring surface potential of the electrostatic latent image or the toner image, or density of the toner image, and finally using control information outputted by a controlling circuit based on information obtained through the measurement. The controlling methods are normally carried out before document copying.

The electrostatic latent image is, for example, formed on the photosensitive body surface by exposing the uniform density patch provided on part of a document platen of a copying machine after a predetermined time elapses since a copying instruction through a copying start key. The toner image is, for example, formed on the photosensitive body surface by developing the exposed uniform density patch with toner.

But, the photosensitive body is not always in the same rotation-starting position upon receiving the copying instruction through the copying start key. As the rotation-starting position of the photosensitive body changes, the electrostatic latent image of the patch or the toner image is not always formed at the same place on the photosensitive body surface.

Consequently, even if uniform density patch is used, various irregularities, depending on the forming place of the electrostatic latent image of the patch, can cause fluctuation in measurement of the surface potential obtained from the electrostatic latent image of the patch, or fluctuation in measurement of the toner image density obtained from the toner image. Here the measurement fluctuation of the toner image density means fluctuation in output by an optical sensor. The irregularities here include mechanical irregularities, such as configuration (roundness) irregularity and rotational displacement of the photosensitive body, and varying photosensitivity depending on places on the photosensitive body surface. Therefore, control information for obtaining the high quality image varies every time a copying process is carried out and here occurs a problem that the best copied image is not constantly available.

Accordingly in recent years, in order to solve the problem, a marking area is provided on the photosensitive body which serves as a reference place. The marking area makes it possible to always measure the surface potential of the exposed electrostatic latent image with respect to the uniform density patch, and the toner image density etc. at the same place on the photosensitive body every time the copying process is carried out. Photosensitive bodies for electrophotographical use having this kind of marking area, for example, are disclosed in Japanese Laid-Open Patent Applications No. 6-35379/1994 (Tokukaihei 6-35379) and No. 6-149136/1994 (Tokukaihei 6-149136). Disclosed in Japanese Laid-Open Patent Application No. 6-35379/1994 is a photosensitive body for electrophotographical use having a marking area provided by, for example, a grinding stone, a grinding processing tape or grinding agent. Disclosed in Japanese Laid-Open Patent Application No. 6-149136/1994 is a photosensitive body for electrophotographical use having a marking area provided through a grinding processing by a laser beam.

Photosensitive bodies made of organic photoconductive material are widely used for the above photosensitive bodies, because the material has beneficial characteristics such as non-polluting and easy in providing a film and in manufacturing. Especially, photosensitive bodies on which a charge producing layer and a charge transporting layer are laminated (so-called lamination type photosensitive bodies) are most widely used.

But, lamination type photosensitive bodies which have been commercialized so far have problems of electrical characteristics such as (1) insufficient photosensitivity, (2) high residual potential of the photosensitive body surface and (3) slow light response. In order to solve the problems, the photosensitivity is improved by thickening the photosensitive layer but here occurs another problem: a thick photosensitivity layer (30 $\mu$m to 40 $\mu$m thick) reduces outline clarity and clearness of the copied image.

Meanwhile, in order to improve the clarity and the clearness of the copied letters, a photosensitive body having a photosensitive layer less than 25 $\mu$m thick has been developed through an improvement in photosensitive material and photosensitive layer structure. But, when the marking area for controlling process factors is provided on this kind of thin photosensitive body, a surface of the photosensitive layer provided right on the marking area becomes less smooth. Here occurs other problems such as inadequate cleaning and toner falling.

SUMMARY OF THE INVENTION

It is an object of the present invention to provide a photosensitive body for electrophotographical use which can constantly produce a high quality copied image and to provide a manufacturing method thereof.

In order to achieve the above object, a photosensitive body for electrophotographical use in accordance with the present invention has:

a conductive base body having a first surface part and a second surface part, the second surface part having different optical reflective characteristics from the first surface part; and a photosensitive layer provided on the conductive base body, wherein the photosensitive layer provided right on the second surface part has a maximum surface roughness of not more than 2.5 $\mu$m, and a ratio of the optical reflective index of the second surface part to the optical reflective index of the first surface part is in a range of 0.3 to 0.7.

With this arrangement, even when the photoconductive layer is thin (e.g., not more than 25 $\mu$m), for example, smoothness of the surface of the photosensitive layer provided right on the second surface part (the marking area) is improved. This smooth surface enables the photosensitive body to avoid problems such as inadequate cleaning and toner falling which, without such arrangement, would be caused by the thin photosensitive layer. Besides, as described here, even when the photoconductive layer is thin, the photosensitive body for electrophotographical use may be provided with the second surface part, thereby improving outline clarity and clearness of copied letters. Therefore, the photosensitive body for electrophotographical use can prevent the problems such as inadequate cleaning and toner falling, and at the same time, can precisely control image forming process factors in reference to a position of the second surface part. Hence, the photosensitive body for electrophotographical use can constantly produce the high quality copied image.

Note that the second surface part is also useful in preventing insertion of a wrong photosensitive body for electrophotographical use of the same size by mistake. The wrong insertion may be detected, for example, by detecting means such as a reflective index measuring sensor. The photosensitive body for electrophotographical use in accordance with the present invention is suitable for use in an electrophotographical device such as a laser printer and a copying machine.

In order to achieve the above object, the photosensitive layer preferably further receives a surface treatment through annealing at about a temperature causing transition of the photosensitive layer to glass phase.

With this arrangement (i.e., annealing), it is possible to even better restrain roughness of the surface of the photosensitive layer, and to further improve surface characteristics such as the smoothness than with the previous arrangement. As a result, the photosensitive body for electrophotographical use in accordance with this arrangement has an excellent ability to control the image forming process factors.

In order to achieve the above object, a method of manufacturing a photosensitive body for electrophotographical use in accordance with the present invention has steps of:

(1) providing a second surface part to a conductive base body having a first surface part, the second surface part having optical reflective characteristics different from those of the first surface part; and (2) providing a photosensitive layer on the conductive base body by applying photosensitive liquid, wherein, in the step (2), the photosensitive liquid application is carried out while the conductive base body is hold so that an upper side of the second surface part is not orthogonal to the gravity direction.

With this arrangement, when the coating liquid is applied on the conductive base body, an excessive amount of the coating liquid flows down along the upper side of the second surface part. Therefore, inadequate coating or so-called liquid sagging can be prevented regardless of a shape of the photosensitive body, a direction of the photosensitive body during the provision of the photosensitive layer, and a shape and size of the second surface part. Hence, the photosensitive body for electrophotographical use manufactured by the above method has an excellent ability to control the image forming process factors and constantly produce the high quality copied image.

In order to achieve the above object, a method of manufacturing a photosensitive body for electrophotographical use in accordance with the present invention has steps of:

(1) providing a second surface part to a conductive base body having a first surface part, the second surface part having optical reflective characteristics different from those of the first surface part;

(2) cleaning the conductive base body after the second surface part is provided; and (3) providing a photosensitive layer on the cleaned conductive base body by applying photosensitive liquid; and wherein, in at least one of the steps (2) and (3), the conductive base body is hold so that the second surface part is below an image forming area with respect to a gravity direction.

With this arrangement, even if inadequate cleaning and coating occur below the second surface part on the conductive base body, the inadequate cleaning and coating occur out of the image forming area. Therefore, the inadequate cleaning and coating do not damage an image.

In order to achieve the above object, a method of manufacturing a photosensitive body for electrophotographical use in accordance with the present invention has steps of:

(1) providing a second surface part to a conductive base body having a first surface part, the second surface part having optical reflective characteristics different from those of the first surface part; and (2) providing a photosensitive layer on the conductive base body by applying photosensitive liquid, wherein, in the step (1), the second surface part is provided to have an unprocessed part continuously extending in a direction not orthogonal to the gravity direction of the conductive base body in the step (2).

With this arrangement, excessive amount of coating liquid or cleaning liquid is easy to flow through the unprocessed part. As a result, the excessive amount of the coating liquid or the cleaning liquid does not adhere to the second surface part. Therefore, inadequate cleaning and coating can be eradicated and time in proceeding to a next step can be shortened. Besides, the arrangement can prevent problems such as inadequate cleaning and toner falling, thus constantly producing the high quality copied image.

In order to achieve the above object, a method of manufacturing a photosensitive body for electrophotographical use in accordance with the present invention has steps of:

(1) providing a second surface part to a conductive base body having a first surface part, the second surface part having optical reflective characteristics different from those of the first surface part; and (2) providing a photosensitive layer on the conductive base body by applying photosensitive liquid, wherein, in the step (1), the second surface is provided to have a groove part.

With this arrangement, an excessive amount of the coating liquid, collected at the two ends of the groove part, flows down smoothly. This makes it possible to decrease a width of an area where inadequate coating occurs, thereby decreasing the area itself. This smaller area improves adhesive strength between the conductive base body and the photosensitive layer, and shortens time in proceeding to a next step.

In case where the groove part is provided in the second surface part, the groove part is preferably provided to extend to a side of the conductive base body.

With this arrangement, the excessive amount of the coating liquid, collected at the two ends of the groove part, inevitably flows down. This further improves the adhesive strength between the conductive base body and the photosensitive layer, and further shortens the time in proceeding to the next step.

In order to achieve the above object, a method of manufacturing a photosensitive body for electrophotographical use in accordance with the present invention has steps of:

(1) providing a second surface part to a conductive base body having a first surface part, the second surface part having optical reflective characteristics different from those of the first surface part; and (2) providing a photosensitive layer by dipping the conductive base body in photosensitive liquid and thereafter, pulling up the conductive base body from the photosensitive liquid, wherein, in the step (2), a pulling-up speed of the conductive base body is changed when the second surface part passes the surface of the photosensitive liquid.

With this arrangement, an excessive amount of the coating liquid adhering to the second surface part can flow down completely when the second surface part, especially, the lower end of the second surface part passes the surface of the coating liquid. This prevents the coating liquid from adhering excessively to the lower part of the second surface part with respect to the gravity direction. As a result, it is possible to maintain uniformity of coating film property and to eradicate inadequate coating in the lower part of the second surface part. Thus, it is possible to obtain the photosensitive body for electrophotographical use constantly producing the high quality copied image.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 through 9, the following description will discuss the present invention.

Figure 1:
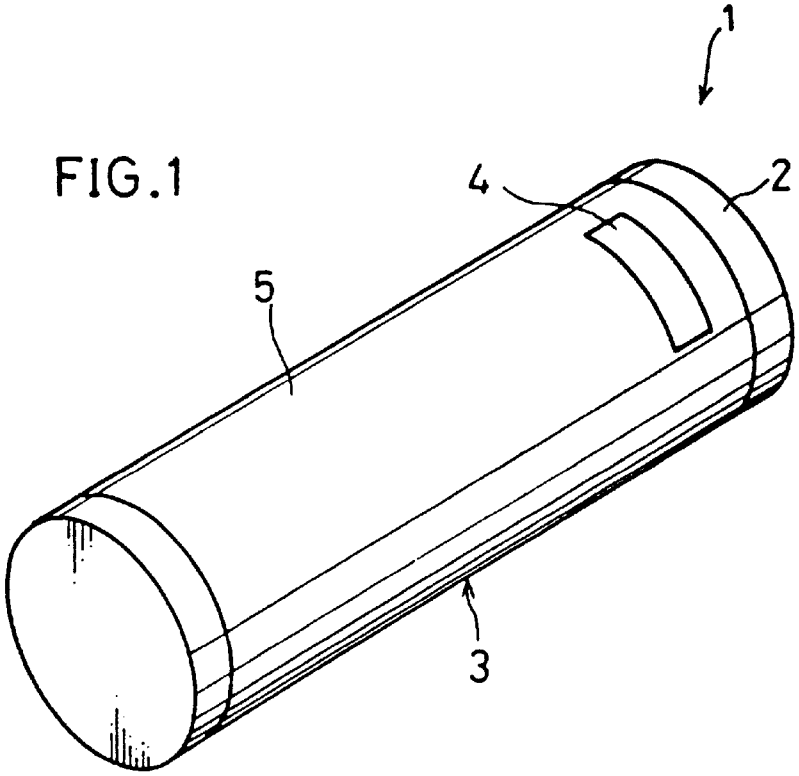
FIG. 1 is a perspective view showing a photosensitive body for electrophotographical use of an embodiment in accordance with the present invention.

As shown in FIG. 1, a photosensitive body for electrophotographical use 1 (hereafter referred to as a photosensitive body 1) in accordance with the present invention has a conductive base body 2 which is, for example, a cylindrical plain tube, and a photosensitive layer 3 provided on the conductive base body 2. The conductive base body 2 has a non-marking area 5 (the first surface) thereon having a predetermined optical reflective characteristic, and a marking area 4 having a different reflective characteristic from that of the non-marking area 5. The photosensitive layer 3 has a photoconductive layer. A structure and a forming method of the photosensitive layer 3 will be later described in detail.

The conductive base body 2 is not necessarily cylindrical, but also can be in other shapes like a board or a no-end belt. The conductive base body 2 is made of metal materials such as aluminum, aluminum alloy, stainless steel, copper and nickel. Various cutting processings and grinding processings such as the mirror finish or the impact shaping is applied to the surface of the conductive base body 2 in order to improve clearness of a printed image.

The marking area 4 is provided on the conductive base body 2 by, for example, making the surface of the conductive base body 2 rough. The marking area 4 serves as a signal source showing the reference place so that after-exposure surface potential with respect to the uniform density patch, or after-exposure toner image density etc. is always measured at the same place on the photosensitive body 1.

The marking area 4 may be provided at any appropriate place between the conductive base body 2 and the photoconductive layer. However, if the marking area 4 is provided in an image forming area on the surface of the conductive base body 2, the marking area 4 may affect a copied image. In other words, a subtle difference in photosensitivity between the marking area 4 and the non-marking area 5 may affect the finished output image such as a copied image. Therefore, the marking area 4 is preferably provided out of the image forming area.

When the marking area 4 is provided out of the image forming area and a development gap holder or roller (not shown) for keeping a development gap is used, the marking area 4 is preferably provided out of a contact area with the development gap holder. If the marking area 4 is provided in the contact area with the development gap holder, the development gap holder contacts the marking area 4 repeatedly. This degrades the contact area surface, i.e., the marking area 4. Moreover, the surface of the photosensitive body 1 becomes dirty with developer and paper dust after used repeatedly. Therefore, the marking area 4 is preferably provided to come, while in operation, into a contact area with a cleaner such as a cleaning blade so that a light reflective index of the marking area 4 does not change.

The marking area 4 may be provided in any appropriate shape such as angular, elliptic, circular and amorphous shapes.

Also, the marking area 4 may be provided in any appropriate size and number.

The marking area 4 may be provided by any appropriate method such as a method utilizing a laser beam, a method utilizing a grinding stone, a method utilizing a grinding processing tape, or a method utilizing grinding agent. Among these methods, the grinding processing utilizing a laser beam is very preferable because stable surface characteristics are always obtainable, its automation is easily realized, and reasonable processing time and processing accuracy are obtainable. Since a laser beam is used, the grinding processing can be carried out in a dry process. Therefore, the laser beam grinding processing, during providing the photosensitive layer 3 subsequently, hardly affects photosensitive body's characteristics and, thus, can restrain a fall of a manufacturing yield of the photosensitive body 1.

Any appropriate laser device, such as a YAG (Yttrium-Aluminum-Garnet) laser or a carbon dioxide laser, may be used. For example, if the YAG laser is used to provide the marking area 4 on the photosensitive body 1 having a photosensitive layer 3 not more than 25 μm thick, the laser is preferably used in a frequency range of 1 kHz to 8 kHz and in an electric current range of 10 A to 30 A. These ranges are decided by considering smoothness of the surface of the photosensitive layer 3 provided on the photosensitive body 1. In other words, an output of the laser beam should be decided in accordance with various conditions such as the materials of the conductive base body 2, the required size of the marking area 4, the thickness of the photosensitive layer 3 and the type of the laser device.

Figure 2:
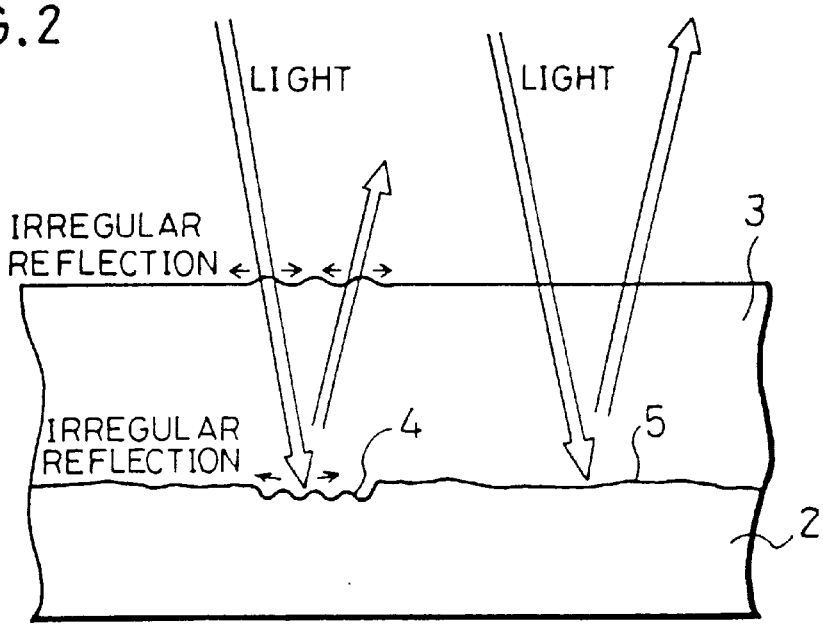
FIG. 2 is a explanatory view showing optical reflective characteristics of the photosensitive body for electrophotographical use which is shown in FIG. 1.

The marking area 4 thus provided has optical reflective characteristics (such as the light reflective index) which are different from those of the non-marking area 5. That is, as shown in FIG. 2, if light which is not absorbed by the photosensitive layer 3 (e.g., an infrared ray of 900 μm wavelength.) is applied to the photosensitive body 1, the light passes through the photosensitive layer 3. The non-marking area 5 reflects most of the light which has passed through the photosensitive layer 3 toward the same direction. Meanwhile, the marking area 4 irregularly reflects the light which has passed through the photosensitive layer 3 because the surface of the marking area 4 is rough. Moreover, a surface of the photosensitive layer 3 provided right on the marking area 4 irregularly reflects some of the light which has passed through the photosensitive layer 3.

In the photosensitive body 1, we have made a research on correlation between the maximum surface roughness of the marking area 4 (hereafter referred to as the base body surface roughness) and that of the photosensitive layer 3 provided right on the marking area 4 (hereafter referred to as the coating film surface roughness), and on correlation between the base body surface roughness and the relative reflective index of the marking area 4 (hereafter referred to as the SN value for convenience). Note that the SN value will be described in a ratio where the reflective index of the non-marking area 5 is 1 and that the photosensitive layer 3 used in the following discussion is 24 μm thick. A result of the research is shown in FIG. 3 and Table 1.

TABLE 1

| Base Body Surface Roughness (μm) | Coating Film Surface Roughness (μm) | SN Value |
|---|---|---|
| 5.50 | 0.90 | 0.70 |
| 6.50 | 1.00 | 0.59 |
| 7.50 | 1.10 | 0.53 |
| 10.00 | 1.30 | 0.41 |
| 10.70 | 1.40 | 0.40 |
| 11.30 | 1.60 | 0.33 |
| 11.70 | 2.00 | 0.34 |
| 12.70 | 2.50 | 0.30 |
| 15.70 | 4.80 | 0.20 |

Figure 3:
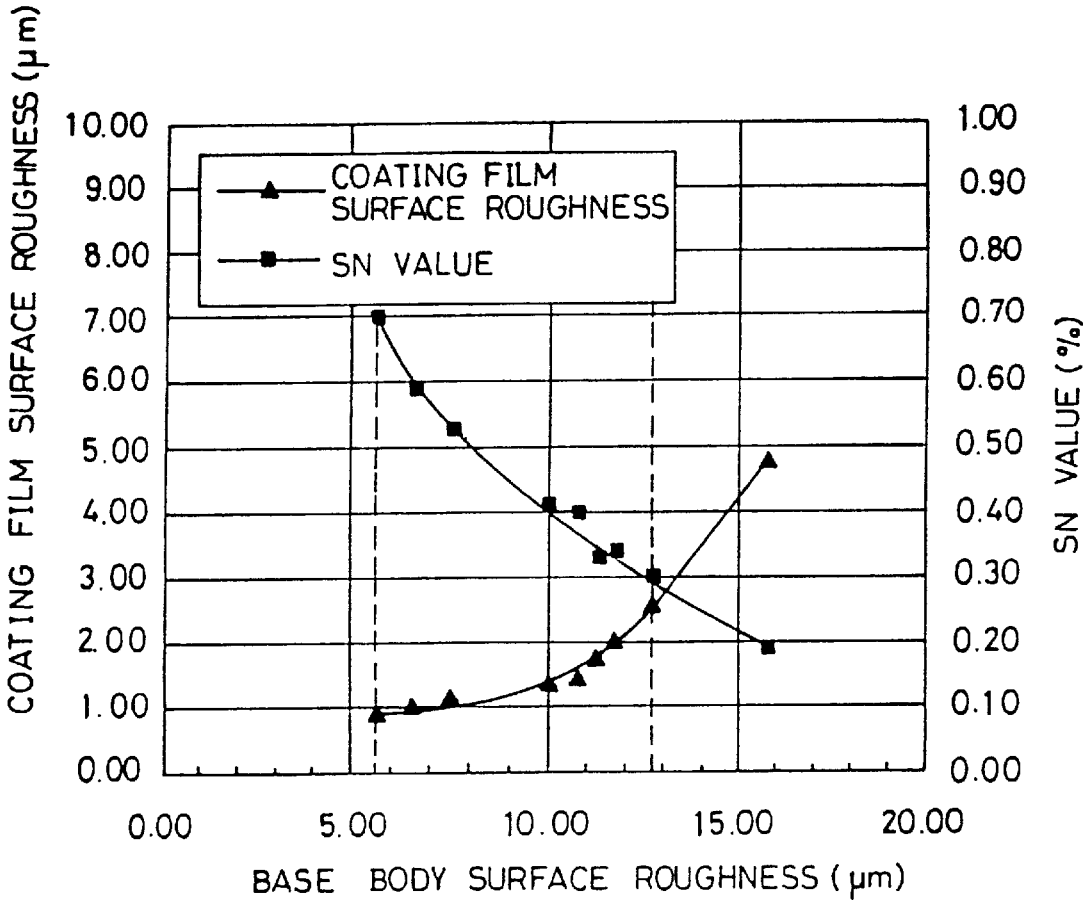
FIG. 3 is a graph showing correlation between base body surface roughness and coating film surface roughness, and further showing correlation between base body surface roughness and SN value.

FIG. 3 and Table 1 clearly show that as the base body surface roughness becomes greater, the coating film surface roughness also becomes greater, but on the contrary, the SN value becomes smaller.

By the way, the marking area 4 is detected by a reflective index measuring sensor (not shown) provided on inside the main body of an electrophotographical device. In other words, the marking area 4 is detected by a judgement whether the reflective index measured by the reflective index measuring sensor falls in a range between two threshold values. The measurement of by the sensor is carried out by applying a light beam to the photosensitive layer 3 and receiving a reflected light beam.

Here, the consideration of the SN value makes it possible to precisely control the image-forming process factors such as the charged potential of the photosensitive body 1, the optical lamp voltage and the toner density. And at the same time, the consideration makes it possible to restrain the surface roughness of the photosensitive layer 3 provided right on the marking area 4. In other words, as FIG. 3 and Table 1 clearly show, as the SN value comes closer to 1, the surface roughness of the photosensitive layer 3 can be better restrained. But as the SN value comes closer to 1, the difference between the optical reflective characteristic of the marking area 4 and that of the non-marking area 5 becomes smaller. Meanwhile, as the SN value becomes smaller, the surface roughness of the photosensitive layer 3 becomes greater.

We made a research and found that the SN value should be specified to be in a range of 0.3 to 0.7 in order to precisely control the process factors and and restrain the problems such as inadequate cleaning and toner falling. To be more specific, in order to precisely control the process factors, the upper limit of the SN value should be specified to be 0.7 with irregularities taken into consideration: for example, an irregular processing in providing the marking area 4, an irregular measurement by the reflective index measuring sensor and scratches on the surface of the photosensitive body 1 within the photosensitive body 1's lifetime. Meanwhile, when the coating film surface roughness is restrained to be not more than 2.5 μm, it is possible to avoid the problems such as inadequate cleaning and toner falling. Therefore, the lower limit of the SN value is specified to be 0.3 in accordance with the result shown in FIG. 3 and Table 1. A control device (not shown) in the main body should be equipped with a program which, if the measured SN value falls in the range of 0.3 to 0.7, recognizes the area measured by the reflective index measuring sensor as the marking area 4. Moreover, in order to avoid the problems such as inadequate cleaning and toner falling, besides specifying the SN value as above, the coating film surface roughness is also specified not to exceed 2.5 μm with various conditions taken into consideration: for example, changes of various conditions, such as the thickness of the photosensitive layer 3 and the laser output.

To summarize the discussion so far, the photosensitive layer 3 should be thin (not exceeding 25 μm) in order to improve outline clarity and clearness of copied letters. However, in a conventional photosensitive body for electrophotographical use, if a marking area is provided on a photosensitive body having a thin photosensitive layer, there occur the problems such as inadequate cleaning and toner falling. Meanwhile, the photosensitive body 1 in accordance with the present invention has the thin photosensitive layer 3 (not exceeding 25 μm) and thus can achieve an improvement on the outline clarity and clearness of copied letters. In addition, the photosensitive body 1 in accordance with the present invention has a marking area. However, unlike the conventional photosensitive body for electrophotographical use, both the coating film surface roughness and the SN value of the photosensitive body for electrophotographical use in accordance with the present invention are specified in the range as discussed above. Such a specification improves, for example, the smoothness of the surface of the photosensitive layer 3 provided right on the marking area 4, and thus enables the photosensitive body 1 in accordance with the present invention to avoid the problems such as inadequate cleaning and toner falling which, without such specifications, would be caused by the thin photosensitive layer.

Note that the reflective index measuring sensor may employ any appropriate light wavelength. However, an infrared ray of a wavelength such as 850 μm and 900 μm is preferably employed by the reflective index measuring sensor in order to minimize affection by dust in the air, dirt on the surface of the photosensitive layer 3 and a defect of the photosensitive layer 3.

When the laser beam is used for grinding processing to provide the marking area 4, the laser beam is generally outputted in pulses so as to carry out a dot processing. In this case, a dot (cavity) 9 is provided with a cavity of, for example, a diameter of 80 μm to 200 μm and a depth of 20 μm to 30 μm (see FIG. 6) depending on the laser beam output. The processed state, i.e., the surface characteristics of the marking area 4, can be controlled by changing a distance between the neighboring dots 9 (a distance between the center of the dot 9 and the center of the neighboring dot 9) as necessary.

The distance between the neighboring dots 9 are set to a certain value during providing the marking area 4. Here, the pitch A are defined as a distance between neighboring dots 9 in a row which is orthogonal to the gravity direction (see FIG. 4) of the conductive base body 2 upon applying cleaning liquid or coating liquid (photosensitive liquid) 6 to the conductive base body 2 (e.g., orthogonal to a pulling-up direction of the conductive base body 2 during the dip-for-cleaning process or dip-for-coating process). Besides, the pitches B are defined as a distance between neighboring dots 9 in a row which is parallel to the gravity direction of the conductive base body 2 upon applying cleaning liquid or coating liquid to the conductive base body 2. Hereafter, the gravity direction of the conductive base body 2 upon applying cleaning liquid or coating liquid to the conductive base body 2 will be simply referred to as the gravity direction of the conductive base body 2. The pitches A and B, generally, have the same value.

But, when the pitches A and B have the same value as described above, the marking area 4 receives more of the coating liquid 6 or the cleaning liquid than the non-marking area 5. Therefore, the marking area 4 takes a longer time to dry naturally than the non-marking area 5 and must wait for a longer time before proceeding on to a next process. If the conductive base body 2 proceeds to the next process before drying naturally, a material used in the previous process goes off from the conductive base body 2 and pollutes the coating liquid 6 or the cleaning liquid of the next process.

Figure 6:
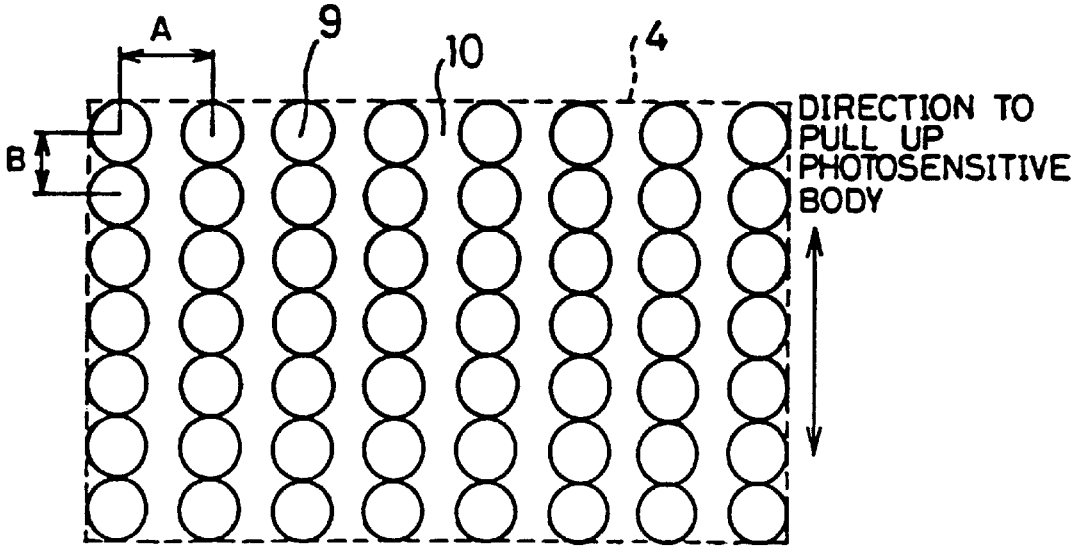
FIG. 6 is a explanatory view showing an example of a processed state of the marking area surface.

In order to solve these problems, instead of making the whole marking area 4 uniformly rough, the pitches A was made greater than the pitch B. And, the processing was carried out in such a manner that part of the marking area 4 was left unprocessed in the processing and was not provided with the dots 9 as shown in FIG. 6. The unprocessed part (hereafter referred to as the unprocessed part 10) was very narrow and continuous corridors carved parallel to the gravity direction of the conductive base body 2. The unprocessed part 10 thus provided could prevent inadequate cleaning and coating.

The unprocessed part 10 has the same surface characteristics as the non-marking area 5. In other words, the surface of the unprocessed part 10 is not as rough as the area provided with the dots 9. Therefore, liquid applied to the marking area 4 such as the cleaning liquid and the coating liquid 6 easily flows down along the unprocessed part 10 provided in the marking area 4. As a result, an excessive amount of the liquid such as the cleaning liquid and the coating liquid 6 does not adhere to the marking area 4. It is thus possible to prevent the inadequate cleaning and coating.

Figure 7:
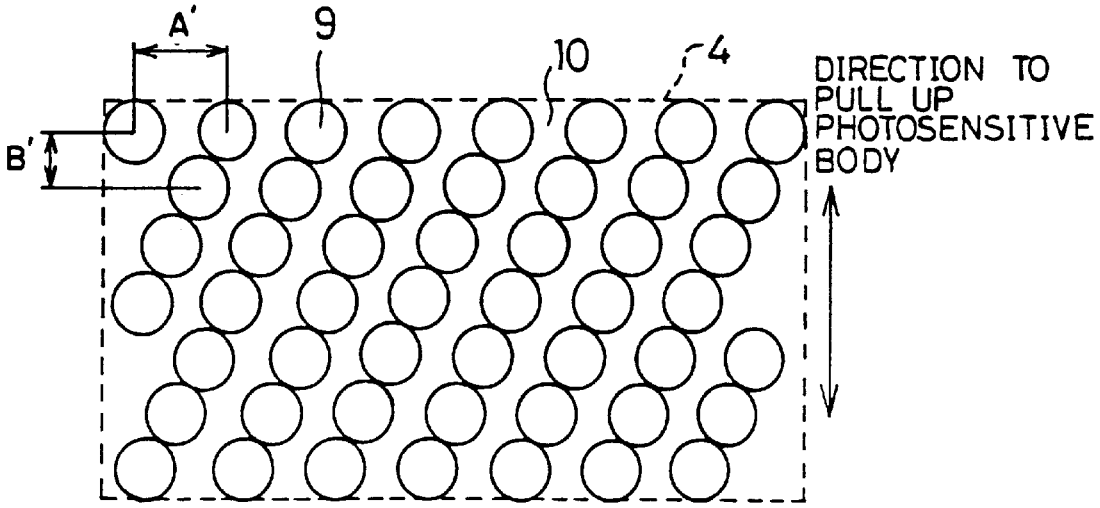
FIG. 7 is a explanatory view showing another example of a processed state of the marking area surface.

Moreover, the dots 9 may be arranged in lines diagonal to the gravity direction of the conductive base body 2 as shown in FIG. 7. Here, the pitch A' is defined as a distance between neighboring dots 9 in a row which is orthogonal to the gravity direction of the conductive base body 2. Besides, the pitch B' is defined as a distance between neighboring dots 9 in a row which is parallel to the gravity direction of the conductive base body 2. The pitch A' is made greater than the pitch B'. And, the processing is carried out in such a manner that part of the marking area 4 is left unprocessed in the processing and is not provided with the dots 9 as shown in FIG. 7. The unprocessed part 10 here is very narrow and continuous corridors carved diagonal to the gravity direction of the conductive base body 2. Liquid applied to the marking area 4 such as the cleaning liquid and the coating liquid 6 easily flows down along the unprocessed part 10 provided in this pattern in the marking area 4. As a result, the excessive amount of the liquid such as the cleaning liquid and the coating liquid 6 does not adhere to the marking area 4. It is thus possible to prevent the inadequate cleaning and coating.

As a result of providing the unprocessed part 10 which is continuous and not orthogonal to the gravity direction of the conductive base body 2, time in proceeding from the cleaning process or the coating process of the coating liquid 6 to a next process (tact time) is shortened.

The pitch A and the pitch A' may take any appropriate ratio to the pitches B and B' respectively. However, the ratios of the pitches A and A' to the pitches B and B' respectively are preferably more than 1 and do not exceed 2. And more preferably, the ratios are not less than 1.25 but do not exceed 2. The pitches A and A', provided to be longer than the pitches B and B' respectively, make it possible to provide the unprocessed part 10 continuously extending not orthogonally to the gravity direction of the conductive base body 2. Meanwhile, if the pitches A and A' are provided to exceed twice the length of the pitches B and B' respectively, amount of the coating liquid 6 applied on the unprocessed part 10 of the conductive base body 2 becomes different from that applied on the processed part of the conductive base body 2, i.e., the part provided with lines made up by the dots 9 of the conductive base body 2. This difference in the amount of the coating liquid 6 may cause an inadequate image such as a void and/or a black point. Therefore, the difference is not preferable.

An area below the marking area 4 in the gravity direction (indicated as the area 53 by slashes in FIG. 9) receives more of the cleaning liquid or the coating liquid 6 because the excessive amount of the cleaning liquid or the coating liquid 6 flows down on the area 53. The photosensitive layer 3 covering the area 53 thus becomes thicker than the photosensitive layer 3 not covering the area 53.

Accordingly, adhesive strength to adhere the photosensitive layer 3 covering the area 53 to the conductive base body 2 becomes weak, for example, if the charge producing layer (described in below) which includes a lot of residue of the coating liquid 6 and organic pigment becomes thick. In actual use, a thick photosensitive layer 3 may be more likely to come off when the photosensitive layer 3 is pushed by a strong pressing force of, for instance, a cleaning blade used in a copying machine provided with the photosensitive body 1.

The adhesive strength refers to a bonding force between the conductive base body 2 and the photosensitive layer 3. The strong pressing force of the cleaning blade is generated by the following mechanism. The cleaning blade is normally pressed by its flexibility against the photosensitive body 1. But if there is a swell of the sagging area, i.e., the area where liquid sagging 15 occurs (see FIG. 4), the cleaning blade is forcibly pushed back by the swell. Thus, the resilient force of the cleaning blade gives the strong pressing force to the sagging area.

Figure 8:
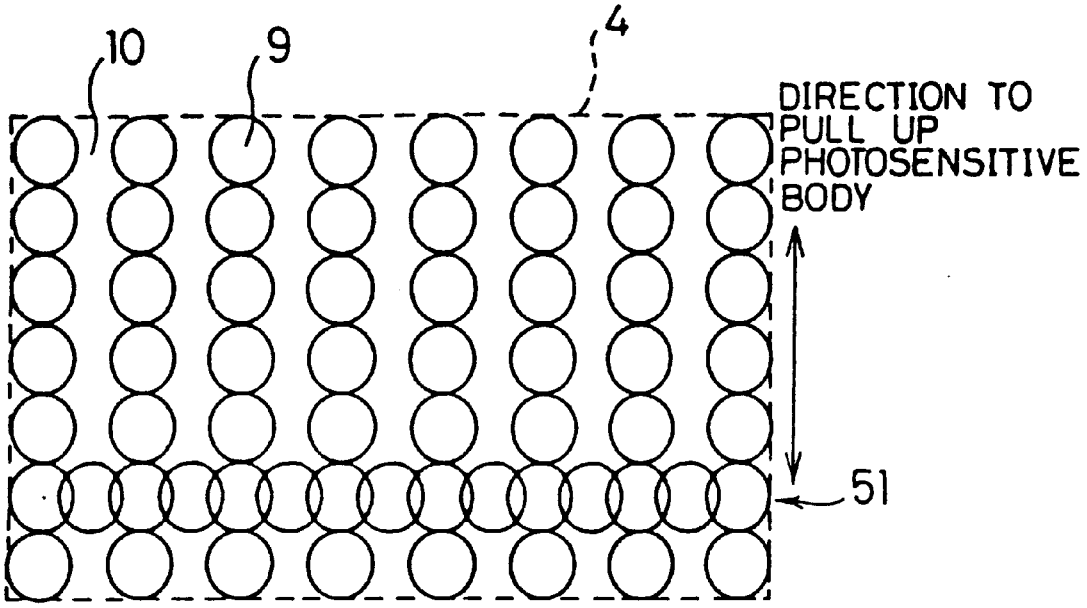
FIG. 8 is a explanatory view showing a groove part provided in the marking area.
Figure 9:
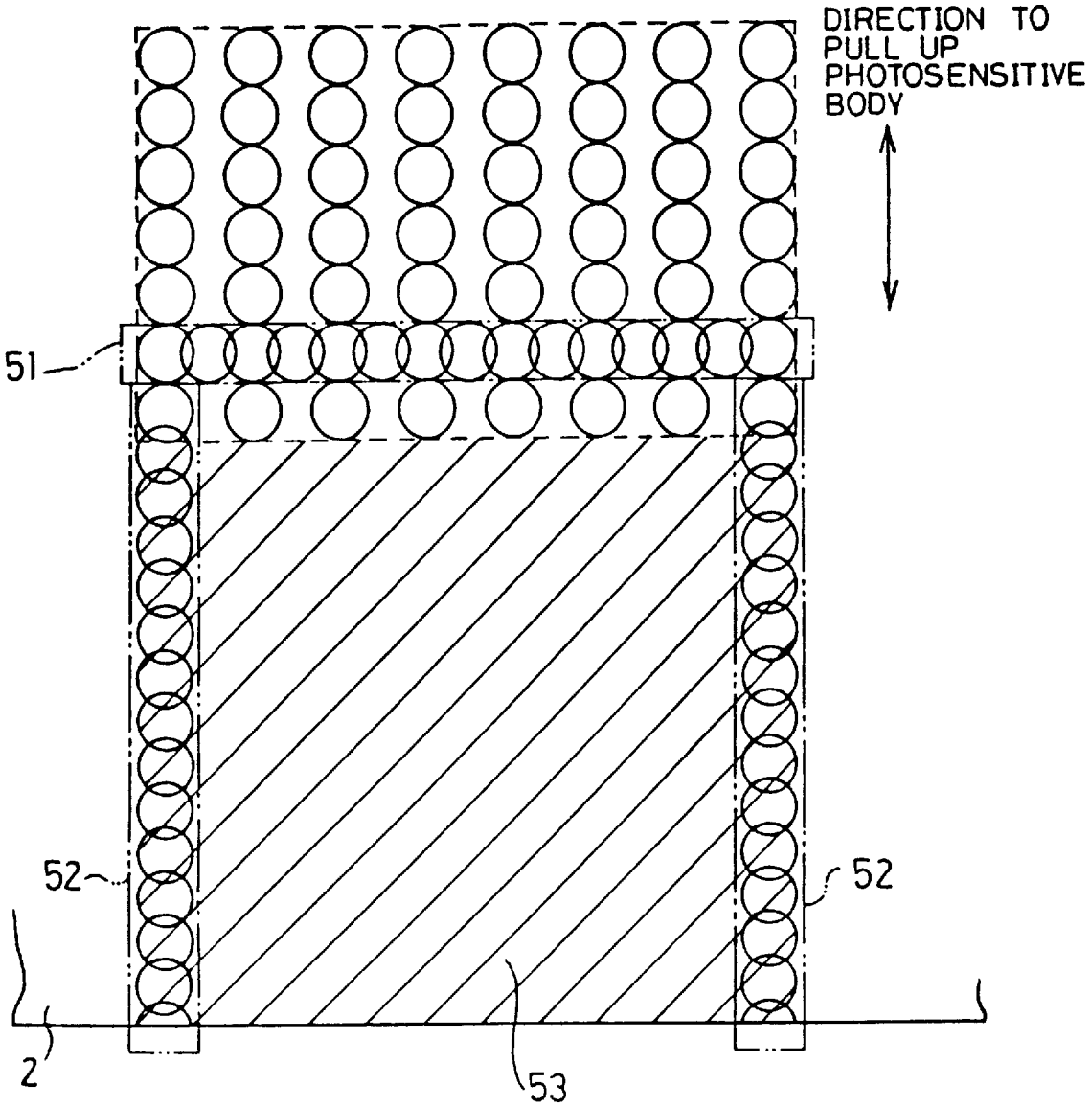
FIG. 9 is a explanatory view showing the groove part extending to a side of the conductive base body.

To eliminate the liquid sagging 15, the marking area 4 is provided with a narrow and shallow carved groove (the groove part) 51. In FIGS. 8 and 9, the carved groove 51 is shown as an area which has dots partially overlapping each other and is enclosed by alternate long and two short dashes lines. The carved groove 51, preferably provided to be orthogonal to the gravity direction of the conductive base body 2, collects the excessive amount of the coating liquid 6 into the two ends of the carved groove 51 and then lets the collected coating liquid 6 flow down smoothly. This makes it possible to decrease the width of the area where inadequate coating such as the liquid sagging 15 occurs, thereby decreasing the area itself. Note that it is possible to provide the carved groove 51 by an easy manner such as adjusting the laser output.

In other words, if the width of the area 53, i.e., the width of the area where irregular thickness of the photosensitive layer 3 occurs, extends a few millimeters, the adhesive strength of the area 53 weakens substantially due to its weak resistance against the strong pressing force of the cleaning blade. On the contrary, if the carved groove 51 is provided, for example, to have the same length as the width of the marking area 4, the sagging liquid 15 can be collected at the carved groove 51. This can reduce the width of the area where the irregular thickness occurs to, for example, about 1 mm and shorten the time during which the cleaning blade gives strong pressing force to the sagging area. It is thus possible to prevent the weakening of the adhesive strength. In short, the adhesive strength is improved by providing the carved groove 51.

Moreover, the provision of the carved groove 51 makes the excessive amount of the coating liquid 6 to be collected at the two ends of the carved groove 51 and flow down smoothly, thereby making it possible to shorten the tact time.

The marking area 4 may be further provided with carved grooves (a groove part) 52 which extend from the two ends of the carved groove 51 to the side of the conductive base body 2. In FIG. 9, the carved grooves 52 are shown as areas which have dots partially overlapping each other and are enclosed by alternate long and two short dashes lines. The carved grooves 52, provided to be parallel to the gravity direction of the conductive base body 2, can force the excessive amount of the coating liquid 6 collected into the two ends of the carved groove 51, i.e., the two sides of the marking area 4, to flow down. This can further shorten the tact time and improve the adhesive strength of the area 53. Note that it is possible to provide the carved grooves 52 by an easy manner such as adjusting the laser output.

The carved grooves 51 and 52 can be easily provided by, for example, adjusting the distance between the neighboring dots 9. To be more specific, the carved grooves 51 and 52 can be provided, when or after the marking area 4 is provided, by continuously applying a laser beam in a straight line so that the dots 9 partially overlaps with each other. The width of the carved groove 51 measured parallel to the pulling-up direction is approximately the same as the diameter of the dot 9. However, the width may be set to any appropriate value as long as the dots 9 in the carved groove 51 do not overlap with the neighboring dots 9 in the pulling-up direction. If the carved groove 51 is provided to partially overlap with the neighboring dots 9 in the pulling-up direction, the width of the carved groove 51 becomes too great and a flat part in the marking area 4 becomes too big. This causes difficulty in collecting the excessive amount of the coating liquid 6 into the carved groove 51.

Similarly to the above case of the carved groove 51, the width of the carved grooves 52 measured parallel to the pulling-up direction is approximately the same as the diameters of the dots 9. However, the width may be set to have any appropriate value as long as the width is great enough to collect the excessive amount of the coating liquid 6 into the carved groove 51.

The carved grooves 51 and 52 may have any appropriate depth. However, the carved grooves 51 and 52 are preferably provided to be 0.5 $\mu$m to 10 $\mu$m deep, and more preferably, 1 $\mu$m to 10 $\mu$m deep. If the carved grooves 51 and 52 are shallower than 0.5 $\mu$m, the carved grooves 51 and 52 become as rough as, or even less rough than, the surface of a widely used conductive base body 2. These too shallow carved grooves 51 and 52 cause difficulty in collecting the excessive amount of the coating liquid 6 into the carved grooves 51 and 52, and are not preferable. Meanwhile, if the carved grooves 51 and 52 are deeper than 10 $\mu$m, these too deep carved grooves 51 and 52 can not solve moire and are therefore not preferable.

The carved groove 51 may be provided at any appropriate place in the marking area 4. However, the carved groove 51 is preferably provided so that the carved groove 51 upon cleaning and applying the coating liquid 6 is along the lower side of the marking area 4 with respect to the gravity direction. The length of the carved groove 51, for above reasons, is preferably the same as the width of the marking area 4. The carved groove 51 may be provided in any appropriate number.

The conductive base body 2 is provided with the marking area 4 and the non-marking area 5 in this manner and then proceeds to a cleaning process. The photosensitive layer 3 is provided on the conductive base body 2 after the cleaning process.

Figure 5:
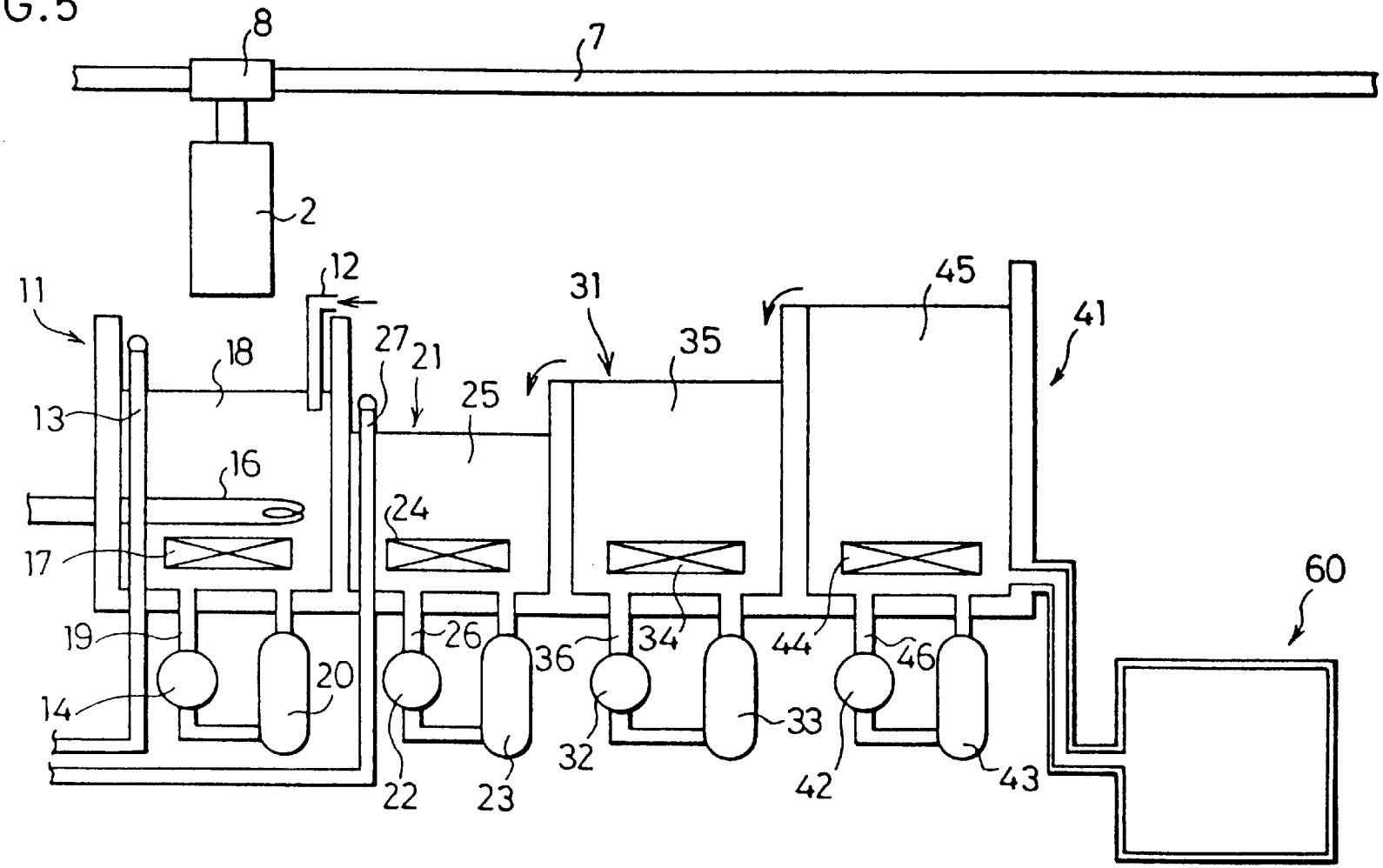
FIG. 5 is a explanatory view showing a cleaning device used for forming the photosensitive body for electrophotographical use of FIG. 1.

The cleaning process of the conductive base body 2 is performed by, for example, a cleaning device shown in FIG. 5. The conductive base body 2 is supported by a robot hand 8 placed on a rail 7. First, the robot hand 8 moves the conductive base body 2 along the rail 7 and stops the conductive base body 2 above a first cleaning tank 11. Secondly, the robot hand 8 lowers the conductive base body 2 to dip the conductive base body 2 in liquid in the first cleaning tank 11. Then, the process is repeated with respect to cleaning tanks 21, 31 and 41 in this order.

The first cleaning tank 11 is filled with cleaning liquid 18 of pure water in which surface active agent is dissolved. The cleaning liquid 18 is heated up by a heater 16 to be in a range of 40 to 60 decrees centigrade. The first cleaning tank 11 is equipped with a supersonic wave generator 17 at the bottom thereof. The supersonic wave generator 17 generates a supersonic wave when the conductive base body 2 is dipped. The cleaning liquid 18 is constantly supplied from a tank (not shown) through a pipe 12 to the first cleaning tank 11.

The cleaning liquid 18 overflowing due to the dipping of the conductive base body 2 is discharged through a pipe 13. The discharged cleaning liquid 18 is then treated by a waste water treatment machine (not shown).

The cleaning liquid 18 polluted with oil, dust and chips which were removed from the base body surface by the cleaning process in the first cleaning tank 11 circulates through a pipe 19, a pump 14 and a filter 20. The dust and chips are collected at the filter 20.

The second, third and fourth cleaning tanks 21, 31 and 41 are filled with pure water of a temperature of 25 degrees centigrade as cleaning liquid 25, 35 and 45 respectively. The cleaning tanks 21, 31 and 41 are equipped with supersonic wave generators 24, 34 and 44 respectively on the bottoms thereof. The cleaning liquid 25, 35 and 45 in the cleaning tanks 21, 31 and 41 respectively circulate through pipes 26, 36 and 46, pumps 22, 32 and 42, and filters 23, 33 and 43 respectively. The dust and chips are collected at the filters 23, 33 and 43.

The pure water used as the cleaning liquid 25, 35 and 45 in the cleaning tanks 21, 31 and 41 respectively is, firstly, supplied from a tank 60 to the fourth cleaning tank 41. Secondly, the pure water overflows from the fourth cleaning tank 41 into the third cleaning tank 31. Thirdly, the pure water overflows from the third cleaning tank 31 into the second cleaning tank 21. Finally, the pure water overflowing from the second cleaning tank 21 is discharged through a pipe 27 and treated by a waste water treatment machine (not shown).

The conductive base body 2 is dipped in the first cleaning tank 11, the second cleaning tank 21, the third cleaning tank 31 and the fourth cleaning tank 41 in this order for cleaning. The conductive base body 2 is dipped in each tank for 0.5 minute to 10 minutes, or preferably, 1.5 minute to 5 minutes. Note that when the conductive base body 2 is dipped for cleaning, the conductive base body 2 may be shaken as necessary.

The conductive base body 2 thus cleaned is dried by, for example, blowing clean air of a temperature of 80 degrees centigrade in a clean booth whose cleanness degree is 100. Then, the conductive base body 2 proceeds to a next process in order to be provided with the photosensitive layer 3.

The photosensitive layer 3 is made of a barrier layer provided on the conductive base body 2 and a photoconductive layer provided on the barrier layer.

Any appropriate conventional barrier layer may be used for the barrier layer: for example, an inorganic layer (such as an aluminum anodic oxide film, aluminum oxide and aluminum hydroxide) and an organic layer (such as polyvinyl alcohol, casein, polyvinyl pirrolidone, polyacrylic acid, cellulose group, gelatin, starch, polyurethane, polyimide and polyamide). The barrier layer may have any appropriate thickness. The photosensitive layer 3 may also include no barrier layer. That is, the photosensitive layer 3 may be made of only a photoconductive layer provided directly on the conductive base body 2.

Any appropriate photoconductive layer may be used for the photoconductive layer: for example, an inorganic photoconductive layer, an organic photoconductive layer and an inorganic-organic combined photoconductive layer. Some examples of the inorganic photoconductive layers are selenium, arsenic-selenium alloy, selenium-tellurium alloy and amorphous silicon. Some examples of the organic photoconductive layers are a so-called lamination type photoconductive layer utilizing a charge producing layer and a charge transporting layer, and a so-called dispersion type photoconductive layer utilizing charge producing substance particles dispersed in a charge transporting medium.

In the lamination type photoconductive layer, the charge producing layer includes charge producing substance for producing a charge in response to incident light. Any appropriate charge producing substance may be used for the charge producing substance: for example, an inorganic photoconductive layer and various organic pigments or dyestuffs. Some examples of the inorganic photoconductive layers are selenium, selenium alloy, arsenic-selenium alloy, cadmium sulfide and zinc oxide. Some examples of the organic pigments and dyestuffs are phthalocyanine, aso die, quinacridone, polycyclic quinone, pyrylium, thiapyrylium, indigo, thioindigo, anthanthrone, pyranethoron and cyanin. Particularly preferable charge producing substances are phthalocyanine, copper indium chloride, gallium chloride, stannic chloride, titanium oxide; metals such as zinc and vanadium and metal oxides of zinc and vanadium; phthalocyanine group having chloride; and pigments such as monoazo, bisazo, trisazo and polyazo.

The charge producing layer may be a vapor deposition layer of the above charge producing substance or a dispersion layer having charge producing substance particles bound by binder resin therein.

Any appropriate binder resin may be used for the binder resin: for example, polyester (such as polyvinyl acetate, polyacrylic ester, polymethyl ester), polycarbonate, polyvinyl acetoacetal, polyvinyl propional, polyvinyl butyral, phenoxy resin, epoxy resin, urethane resin, cellulose ester and cellulose ether.

The ratio of the charge producing substance to the binder resin should be within a range of 30 to 500 parts by weight of the charge producing substance per 100 parts by weight of the binder resin. Thickness of the charge producing layer is preferably 0.1 $\mu$m to 2 $\mu$m and more preferably, 0.15 $\mu$m to 0.8 $\mu$m. If a charge producing layer is thicker than 2 $\mu$m, the photosensitive layer 3 becomes thick. This reduces outline clarity and clearness of copied letters and therefore is not preferable. Note that an additive for improving coating property such as levelling agent, antioxidant and sensitizer may be added to the charge producing layer as necessary.

Meanwhile, the charge transporting layer of the lamination type photoconductive layer is made of (1) charge transporting substance which is able to accept and transport the charge produced by the charge producing substance and (2) binder resin. Any appropriate substance may be used for the charge transporting substance: for example, electron donative substance and electron acceptive substance. Some of the examples of the electron donative substance are poly-N-vinyl carbazole, derivative of poly-N-vinyl carbazole, poly-γ-carbazolyl ethyl glutamate, derivative of poly-γ-carbazolyl ethyl glutamate, pyrene-formaldehyde condensate, derivative of pyrene-formaldehyde condensate, polyvinyl pyrene, polyvinyl phenanthrene, derivative of oxazole, derivative of oxodiazole, derivative of imidazole, 9-(p-diethylaminostyryl)anthracene, 1,1-bis(4-dibenzilaminophenyl)propane, 1,1-bis(p-diethylaminophenyl)-4,4-diphenyl-1,3-butadiene, styryl anthracene, styryl pyrazoline, phenyl hydrazone group and derivative of hydrazone. Some of the examples of the electron acceptive substance are derivative of fluorenone, derivative of dibenzothiophene, derivative of indenothiophene, derivative of phenanthrenequinone, derivative of indenopiridine, derivative of thioxanthene, derivative of benzo[c]cinnoline, derivative of phenazineoxide, tetracyanoethylene, tetracyanoquinolidimethane, bromanyl, chloranil and benzoquinone.

Any appropriate substance having compatibility with the charge transporting substance may be used for the binder resin: for example, vinyl polymer and copolymer (such as polymethyl metacrylate, polystyrene and polyvinylchloride), resin (such as polycarbonate resin, polyester resin, polyestercarbonate resin, polysulfone resin, polyimide resin, phenoxy resin, epoxy resin and silicon resin) and partially bridged hardener of these compounds.

The ratio of the charge transporting substance to the binder resin should be within a range of 30 to 200 parts by weight of the charge transporting substance per 100 parts by weight of binder resin and preferably, within a range of 40 to 150 parts by weight. Thickness of the charge transporting layer is preferably 10 μm to 60 μm and more preferably, 10 μm to 45 μm. In order to further improve outline clarity and clearness of copied letters, the thickness of the photosensitive layer 3 preferably does not exceed 25 μm. Therefore, the charge transporting layer is preferably as thin as possible. Note that an additive such as antioxidant and sensitizer may be added to the charge transporting layer as necessary.

Moreover, if the lamination type photoconductive layer is used as a photoconductive layer, it is also possible to provide a conventional overcoating layer which is mainly made of, for example, thermoplastic polymer or thermosetting polymer.

The dispersion type photoconductive layer has the charge producing substance dispersed in a matrix which is mainly made of the binder resin and the charge transporting substance provided in the above ratio. The particle diameter of the charge producing substance should be small and, preferably, should not exceed 0.5 μm. The ratio of the charge producing substance to the matrix should be in a range of 0.5 to 50 percent by weight and preferably, 1 to 20 percent by weight. If the charge producing substance is less than 0.5 percent by weight, it is impossible to obtain enough sensitivity. Meanwhile, if the charge producing substance is more than 50 percent by weight, there occur unpreferable problems such as degradation of charging property and sensitivity.

Note that an additive may be added to the dispersion type photoconductive layer as necessary. The additive includes plasticizer for improving film-forming property, flexibility, mechanical strength, an additive for restraining residual potential, dispersion auxiliary agent for dispersion stability, levelling agent for improving coating property and surface active agent: for example, silicon oil and fluorine oil.

The photosensitive layer 3 may be provided (applied) by any appropriate method: for example, the dip-for-coating method, ring coating method, the spraying method.

Wetability of the marking area 4 is different from that of the non-marking area 5 because of the rough surface of the marking area 4. Therefore, conventionally, for example, when the cleaning process is carried out by the dip-for-cleaning method or the coating process is carried out by the dip-for-coating method (the so-called dipping method), certain variations in the shape and the size of the marking area 4 cause inadequate cleaning and coating such as liquid sagging extending from the marking area 4 (See FIG. 4). Moreover, the variations may cause liquid sagging 15 (shown as alternative long and two short dashes lines in FIG. 4).

A possible reason for the liquid sagging 15 due to the inadequate cleaning and/or coating may be explained as follows. Amount of the cleaning liquid 18, 25, 35 and 45 and, amount of the coating liquid 6 which adhere to the surface of the conductive base body 2 are determined by relationships among the surface characteristics of the conductive base body 2, physical property of the cleaning liquid 18, 25, 35 and 45, and of the coating liquid 6, and a speed to pull up the conductive base body 2 upon cleaning and/or coating. When the conductive base body 2 is pulled up, amount of the cleaning liquid 18, 25, 35 and 45, and amount of the coating liquid 6 which adhere to the surface of the conductive base body 2 vary depending on the surface characteristics thereof. Namely, the marking area 4 has a rough surface and therefore, the cleaning liquid 18, 25, 35 and 45 and the coating liquid 6 stay more with the marking area 4 than with the rest of the surface. An excessive amount of the cleaning liquid 18, 25, 35 and 45, and of the coating liquid 6 on the marking area 4, thus, causes the liquid sagging 15 at the boundary of the marking area 4 and non-marking area 5.

If the conductive base body 2 is hold for cleaning or coating in such a manner that the marking area 4 is above the image forming area with respect to the gravity direction, the cleaning liquid 18, 25, 35 and 45, and the coating liquid 6 stay more with the marking area 4 than with the rest of the surface. To be more specific, the rest of the surface here refers to the area which is out of both the marking area 4 and the image forming area. This causes the liquid sagging 15 which then damages an image formed in the image forming area below the marking area 4. Here occurs a non-uniform latent image on the photosensitive body 1, i.e., a non-uniform copied image.

Meanwhile, if the conductive base body 2 is hold for cleaning or coating in such a manner that the marking area 4 is below the image forming area with respect of the gravity direction, it is possible to prevent a damage on the image. In other words, even if inadequate cleaning and/or coating below the marking area 4 occur(s), the inadequate cleaning and/or coating occur(s) only out of the image forming area, and therefore, the image is not damaged. In order to hold the conductive base body 2 in such a manner that the marking area 4 is below the image forming area in the cleaning and coating processes, the marking area 4 should be out of the image forming area. Besides, the conductive base body 2 should be hold upright upon cleaning and coating with the marking area 4 side down.

Moreover, an inadequate image due to the liquid sagging 15 is prevented by the unprocessed part 10, the carved groove 51 and the carved grooves 52 provided in the marking area 4.

The liquid sagging 15 is also prevented, upon providing the photosensitive layer 3 in a manufacturing process to manufacture the photosensitive body 1, by holding the conductive base body 2 in such a manner that the upper side of the marking area 4 is not orthogonal to the gravity direction. This is explained in detail below.

In order to obtain the above effect, the coating liquid 6 should be applied to the conductive base body 2 which is hold diagonally, i.e., in such a manner that the upper side of a square marking area 4 is not orthogonal to the gravity direction. Besides, for example, the coating liquid 6 should be applied to the conductive base body 2 having a marking area 4 which is provided in such a shape that the upper side thereof is not orthogonal to the gravity direction.

Figure 4:
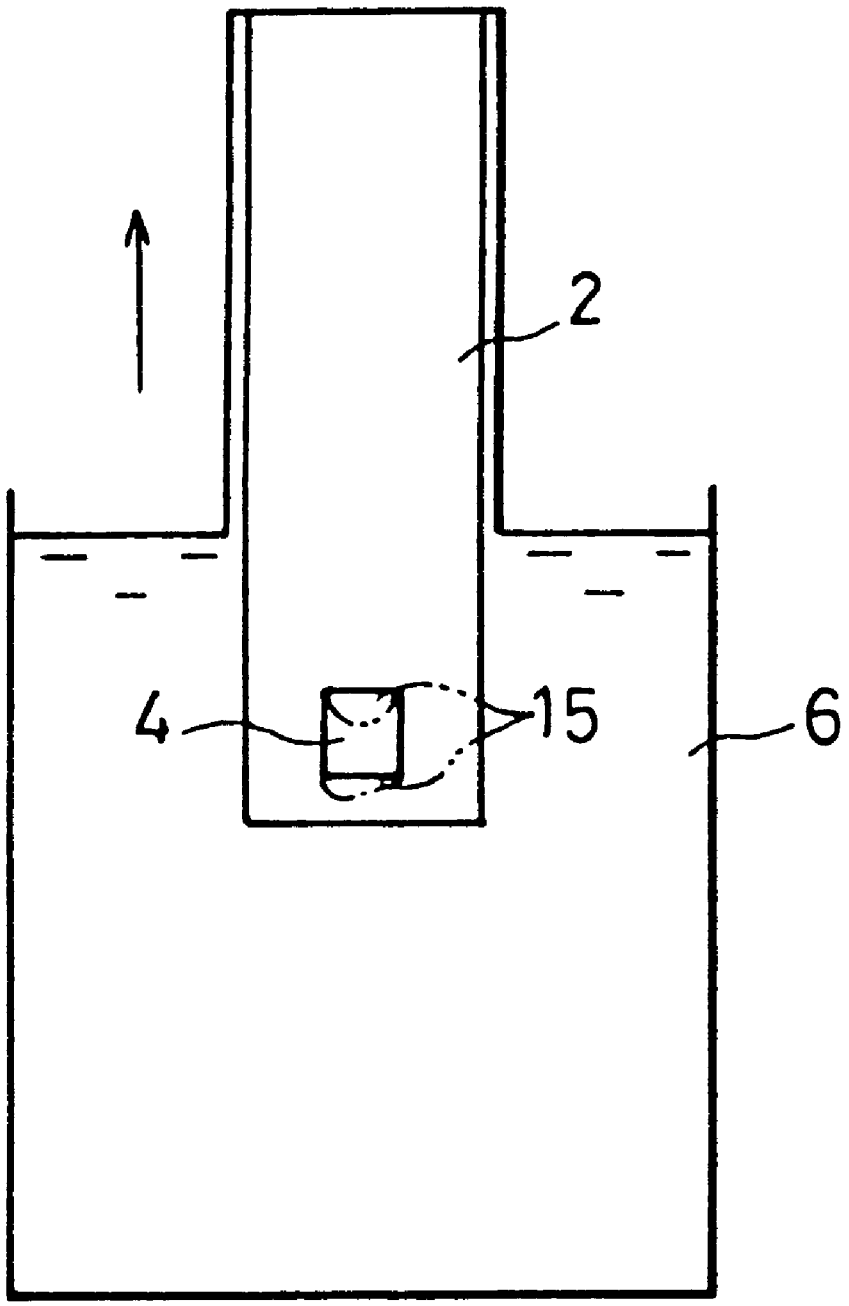
FIG. 4 is a explanatory view showing an example of a coating method of photosensitive liquid on a conductive base body having the marking area.

Referring to FIG. 4, a specific example is given in the following description with respect to a method for providing the photosensitive layer 3. Note that the example refers to a case where the photosensitive layer 3 is provided by the dip-for-coating method on a cylindrical conductive base body 2 having a quadrangle marking area 4. And in the dip-for-coating process, the conductive base body 2 is hold upright with the marking area 4 side down, dipped in the coating liquid 6 which will become the photosensitive layer 3 and pulled upward (i.e., in the upward direction parallel to the cylindrical axis of the conductive base body 2) from the coating liquid 6.

The upper side of the marking area 4 (hereafter referred to simply as the upper side) is set so as to tilt from the circumference direction of the conductive base body 2 when the conductive base body 2 is hold upright. In other words, the upper side of the marking area 4 is set so as not to be orthogonal to the gravity direction. This enables the coating liquid 6 applied in the excessive amount to flow down along the upper side of the marking area 4. The liquid sagging 15 is prevented by applying the coating liquid 6 in this manner.

The above effect is obtained, as described above, by setting the upper side of the marking area 4 to tilt from the circumference direction of the conductive base body 2. If the upper side of the marking area 4 is set to make an angle of 15 degrees or more to the circumference direction of the conductive base body 2, a better effect is obtained.

In this case, the most important factor is to set the upper side of the marking area 4 not to be orthogonal to the gravity direction. Therefore, various other factors are less important and may be decided as necessary: namely, the conductive base body 2 may take any appropriate shape; the marking area 4 may take any appropriate shape and size; the conductive base body 2 may be pulled up in any appropriate direction. Even any appropriate type of coating liquid with any appropriate physical property such as viscosity may be used as the coating liquid 6. For example, if the angle of the upper side of the marking area 4 to the circumference direction of the conductive base body 2 is appropriately set according to the type and the physical property (such as viscosity) of the coating liquid 6, the above effect is obtainable.

It is also possible to prevent the excessive amount of the coating liquid 6 below the marking area 4 by changing a pulling-up speed while pulling up the conductive base body 2 from the cleaning liquid 18, 25, 35 or 45 or the coating liquid 6 in the dip-for-cleaning process or the dip-for-coating process. It is thus possible to obtain uniform characteristics of the coating film on the non-marking area 5. In other words, if the pulling-up speed is slowed down, or decreased to zero for a short time while pulling up the lower part of the conductive base body 2 from the liquid, the excessive amount of the cleaning liquid 18, 25, 35 and 45 and of the coating liquid 6 which is adhering to the whole marking area 4 flows down and falls into the cleaning tanks 11, 21, 31 and 41 and the coating tank respectively. It is thus possible to prevent inadequate coating below marking area 4. In this case, the marking area 4 may be either above or below the image forming area with respect to the gravity direction.

Next, as the last process to provide the photosensitive layer 3, the coating liquid 6 is heated up and dried to remove residual solvent in the coating liquid 6 applied on the conductive base body 2. The smoothness of the surface of the photosensitive layer 3 provided right on the marking area 4 is improved by providing the photosensitive layer 3 through the above coating method and by thus preventing the liquid sagging 15 in the manufacturing process of the photosensitive body 1. Therefore, the method can precisely control the process factors and provide the photosensitive body 1 which is capable to constantly obtain a good copied image. Note that it is possible to obtain a photosensitive layer 3 of more than one layer by repeating the process incorporating the above coating method in accordance with the number of layers of the photosensitive layer 3.

Moreover, the surface of the photosensitive layer 3 may be treated by annealing for a few hours at about a temperature causing transition of the photosensitive layer 3 to glass phase in accordance with various conditions such as the type and the film thickness of the photosensitive layer 3. Such a treatment restrains the roughness of the surface of the photosensitive layer 3 provided right on the marking area 4, thereby further improving the surface characteristics such as smoothness and restraining the problems such as inadequate cleaning and toner falling. Consequently, the photosensitive body 1, provided with a superior ability to control the process factors, constantly produces a high quality copied image.

The following description will discuss embodiments as well as comparative examples in detail with respect to the present invention. However, these embodiments are only illustrative and not restrictive. Here, for convenience, "percent by weight" is simply referred to as "%".

The conductive base body 2 is cleaned by the same method as explained above. That is, first, the conductive base body 2 is dipped and cleaned in the cleaning liquid 18 in the first cleaning tank 11 at a temperature of 50 degrees centigrade for 2 minutes. 5% solvent of Polarclean made by Tanaka Importgroups Co., Ltd. is employed here as the cleaning liquid 18. Secondly, the conductive base body 2 is dipped and cleaned in 5% solvent of Polarclean which is prepared for cleaning in the second cleaning tank 21, the third cleaning tank 31 and the fourth cleaning tank 41 in this sequence at a temperature of 25 degrees centigrade for 2 minutes in each tank. Finally, the conductive base body 2 thus cleaned by dipping is dried by blowing clean air of a temperature of 80 degrees centigrade in a clean booth whose cleanness degree is 100.

The marking area 4 is evaluated by a reflective index measuring sensor (not shown) provided in the main body of an electrophotographical device. In other words, the evaluation is conducted by a light emitting diode and a phototransistor. The light emitting diode applies a light beam of 900 $\mu$m wavelength to the photosensitive body 1. The phototransistor receives the light beam reflected at the photosensitive body 1. The photosensitive body 1 is then installed in a copying machine equipped with a so-called process control system and a marking area detecting sensor in order to confirm initial condition of the photosensitive body 1 (hereafter referred to as the initial confirmation), and in order to conduct trial copying of 50000 sheets.

Embodiment 1

A conductive base body 2 was made of an aluminum cylinder of an outer diameter of 80 mm, a length of 348 mm and a thickness of 1.0 mm, and received the mirror finish so that its maximum surface roughness did not exceed 0.2 μm. Next, part of the surface of the conductive base body 2 was made rough to provide a marking area 4. To be more specific, a laser beam was applied to a place 20 mm away from one of the ends of the conductive base body 2 to provide the marking area 4. The marking area 4 here was of a square shape with a dimension of 8 mm×8 mm and one side of the square marking area 4 was parallel to the circumference direction of the conductive base body 2. Also, the marking area 4 was located (1) in a contact area with a cleaning blade but (2) out of an image forming area and (3) out of a contact area with a development gap holder. A YAG laser (SL-475G made by NEC Corporation) was used for the above laser beam application at an output of electric current of 15.6 A and of frequency of 2.4 kHz. A diameter of dots 9 provided by the laser beam was 80 μm. According to a measurement of the conductive base body 2 by a predetermined method, its base body surface roughness was 12.0 μm.

Next, the conductive base body 2 was cleaned by a predetermined method. Then, a lamination type photoconductive layer as an organic photoconductive layer was provided by a dip-for-coating method. In the coating process, the conductive base body 2 was hold upright with the marking area 4 side down, dipped in coating liquid 6 and then pulled upward (i.e., in the upward direction parallel to the cylindrical axis of the conductive base body 2) from the coating liquid 6.

To be more specific, 1 part by weight of dibromo anthanthorone (charge producing substance) and 1 part by weight of butyral resin (binder resin, Eslec BM-2 made by Sekisui Chemical Co., Ltd.) were dissolved in 120 parts by weight of cyclohexanone (solvent) and dispersed by a ball mill for 12 hours to prepare the coating liquid (dispersion liquid) 6. Then, the conductive base body 2 was dipped in the prepared coating liquid 6 to be coated therewith. The coated conductive base body 2 was, finally, dried at a temperature of 80 degrees centigrade for half an hour to be provided with a charge producing layer having a thickness of 0.5 μm.

Next, 1 part by weight of hydrazone charge transporting agent (ABPH made by Nippon Kayaku Co., Ltd.), 1 part by weight of polycarbonate (binder resin, Panlite L-1250 made by Teijin Kasei Co., Ltd.) and 0.00013 part by weight of silicon levelling agent (KF-96 made by Shin-Etsu Chemical Co.,) were added to 8 part by weight of ethylene chloride (solvent). This chemical compound was then heated at 45 degrees centigrade until these three solutes were solved completely, and left to cool down naturally. Second coating liquid 6 was thus obtained. The conductive base body 2 which was already provided with the charge producing layer was dipped in the second coating liquid 6 to be coated therewith. Thereafter, the conductive base body 2 was dried at a temperature of 80 degrees centigrade for an hour to be provided with a charge transporting layer. A photosensitive body 1 was thus provided with a photosensitive layer 3 having a thickness of 23 μm.

According to an evaluation of the marking area 4 provided to the photosensitive body 1 above, its SN value was 0.33 and its coating film surface roughness was 2.0 μm. According to an initial confirmation and a trial copying, quality standard of copied images in an initial stage was maintained throughout the lifetime of the photosensitive body 1 and no particular problem occurred. These results are shown in FIG. 2.

Comparative Example 1

A marking area 4 was provided by applying the same grinding processing to a conductive base body 2 as the marking area 4 of the embodiment 1 except some changes in a laser output: namely, the electric current was changed from 15.6 A to 16 A and the frequency was changed from 2.4 kHz to 2.3 kHz. A diameter of the dots 9 provided by the laser beam was 80 μm. According to a measurement of the processed conductive base body 2, its base body surface roughness was 13.0 μm.

Next, a comparative photosensitive body 1 was made from the conductive base body 2 by the same manufacturing method as the photosensitive body 1 of the embodiment 1. During the process to provide a photosensitive layer 3 to the conductive base body 2, liquid sagging 15 was seen to extend from the marking area 4.

According to an evaluation of the marking area 4 provided in the comparative photosensitive body 1, its SN value was 0.30 and its coating film surface roughness was 2.90 μm. According to an initial confirmation and a trial copying, problems such as inadequate cleaning and toner falling were observed. These results are shown in FIG. 2.

Embodiment 2

A marking area 4 was provided by applying the same grinding processing to a conductive base body 2 of the same type as in the embodiment 1.

Next, the conductive base body 2 was cleaned by a predetermined method. Then, a lamination type photoconductive layer as an organic photoconductive layer was provided by a same dip-for-coating method as in the embodiment 1 except some changes in ingredient of coating liquid 6.

Namely, first, 6 parts by weight of copolymer nylon resin (CM4000 made by Toray Industries Inc.) was solved in 94 parts by weight of methanol (solvent) to prepare coating liquid 6. The conductive base body 2 was dipped in the coating liquid 6 to be coated therewith. Thereafter, the conductive base body 2 was dried under a predetermined conditions to be provided with a barrier layer having a thickness of 1.0 μm.

Secondly, 2 parts by weight of chlorodianblue (charge producing substance made by Nippon Kayaku Co., Ltd.) and 1 part by weight of polyester (binder resin, Vylon 200 made by Toyobo Co., Ltd.) were solved in 100 parts by weight of ethylenediamine (solvent) and dispersed by a ball mill for 8 hours to prepare second coating liquid 6. The conductive base body 2 which was already provided with the barrier layer was dipped in the second coating liquid 6 to be coated therewith. Thereafter, the conductive base body 2 was dried at a temperature of 80 degrees centigrade for half an hour to be provided with a charge producing layer having a thickness of 0.4 μm.

Thirdly, 1 part by weight of 1,1-bis(p-diethylaminophenyl)-4,4-diphenyl-1,3-butadiene (butadiene charge transporting agent made by Takasago Corporation), 1 part by weight of polycarbonate (Panlite L-1225 made by Teijin Kasei Co., Ltd.), 0.00013 part by weight of silicon levelling agent (KF-96 made by Shin-Etsu Chemical Co., Ltd.) were added to 10 parts by weight of ethylene chloride (solvent) to prepare third coating liquid 6. The conductive base body 2 above which was already provided with the charge producing layer was dipped in the third coating liquid 6 to be coated therewith. Thereafter, the conductive base body 2 was dried at a temperature of 80 degrees centigrade for an hour to be provided with a charge transporting layer. The photosensitive body 1 was thus provided with a photosensitive layer 3 having a thickness of 24 μm.

According to an evaluation of the marking area 4 provided in the photosensitive body 1, its SN value was 0.40 and the coating film surface roughness was 1.30 μm. According to an initial confirmation and a trial copying, quality standard of copied images in an initial stage was maintained throughout the lifetime of the photosensitive body 1 and no particular problem occurred. These results are shown in Table. 2.

Embodiment 3

A photosensitive body 1 was provided by the same manufacturing method as the photosensitive body 1 of the embodiment 2 except a change in thickness of a photosensitive layer 3 μm to 20 μm.

Next, the photosensitive body 1 was left at a temperature causing transition of the photosensitive layer 3 to glass phase for 10 hours (annealing). According to an evaluation of a marking area 4 of the photosensitive body 1 after the annealing, its SN value was 0.30 and its coating film surface roughness was 2.40 μm. According to an initial confirmation and a trial copying, quality standard of copied images in an initial stage was maintained throughout the lifetime of the photosensitive body 1 and no particular problem occurred. These results are shown in Table. 2.

Comparative Example 2

A comparative photosensitive body 1 was provided by the same manufacturing method as the photosensitive body 1 of the embodiment 3 except that no annealing process was applied to the comparative photosensitive body 1 of the comparative example 2.

According to an evaluation of a marking area 4 of the comparative photosensitive body 1, its SN value was small at 0.20 and its coating film surface roughness was large at 2.70 μm. According to an initial confirmation and a trial copying, inadequate cleaning was observed. These results are shown in Table. 2.

Embodiment 4

A marking area 4 was provided by applying the same grinding processing to a conductive base body 2 as the marking area 4 of the embodiment 2 except a change in electric current of the laser output from 15.6 A to 15.4 A. Next, a photosensitive body 1 was made from the conductive base body 2 by the same manufacturing method as in the embodiment 2.

According to an evaluation of the marking area 4 provided in the photosensitive body 1, its SN value was 0.70 and its coating film surface roughness was 0.90 μm. According to an initial confirmation and a trial copying, quality standard of copied images in an initial stage was maintained throughout the lifetime of the photosensitive body 1 and no particular problem occurred. These results are shown in Table 2.

Embodiment 5

A photosensitive body 1 was provided by the same manufacturing method as the photosensitive body 1 of the embodiment 1 except a change in shape of a marking area 4. Namely, the embodiment 1 employed a square shape of a dimension of 8 mm×8 mm provided to be parallel to a circumference direction of a conductive base body 2. The embodiment 5 employed a quadrangle shape whose upper side was set to make a 15 degree angle to the circumference direction of the conductive base body 2.

According to an evaluation of the marking area 4 provided to the photosensitive body 1, its SN value was 0.30 and its coating film surface roughness was 2.40 μm. According to an initial confirmation and a trial copying, quality standard of copied images in an initial stage was maintained throughout the lifetime of the photosensitive body 1 and no particular problem occurred. These results are shown in Table 2.

Embodiment 6

A photosensitive body 1 was provided by the same manufacturing method as the photosensitive body 1 of the embodiment 1 except a change in shape of a marking area 4. Namely, the embodiment 1 employed a square shape of a dimension of 8 mm×8 mm provided to be parallel to a circumference direction of a conductive base body 2. The embodiment 6 employed a quadrangle shape whose upper side was set to make a 20 degree angle to the circumference direction of the conductive base body 2.

According to an evaluation of the marking area 4 provided to this photosensitive body 1, its SN value was 0.30 and its coating film surface roughness was 2.40 μm. According to an initial confirmation and a trial copying, quality standard of copied images in an initial stage was maintained throughout the lifetime of the photosensitive body 1 and no particular problem occurred. These results are shown in Table 2.

TABLE 2

| | THICKNESS OF PHOTOSENSITIVE LAYER (μm) | SHAPE OF MARKING AREA | SN VALUE | COATING FILM SURFACE ROUGHNESS (μm) | CONDITION | ANY LIQUID SAGGING | ANY PROBLEM |
|---|---|---|---|---|---|---|---|
| EMBODIMENT 1 | 23 | □ | 0.33 | 2.0 | — | NO | NO |
| COMPARATIVE EXAMPLE 1 | 23 | □ | 0.30 | 2.90 | STRONG LASER OUTPUT IS USED | YES | INADEQUATE CLEANING AND TONER FALLING |

TABLE 2-continued

| | THICKNESS OF PHOTOSENSITIVE LAYER (μm) | SHAPE OF MARKING AREA | SN VALUE | COATING FILM SURFACE ROUGHNESS (μm) | CONDITION | ANY LIQUID SAGGING | ANY PROBLEM |
|---|---|---|---|---|---|---|---|
| EMBODIMENT 2 | 24 | | 0.40 | 1.30 | — | NO | NO |
| EMBODIMENT 3 | 20 | | 0.30 | 2.40 | PHOTOSENSITIVE BODY SURFACE IS TREATED BY ANNEALING AT 70 DEGREES CENTIGRADE FOR 10 HOURS | NO | NO |
| COMPARATIVE EXAMPLE 2 | 20 | | 0.20 | 2.70 | — | NO | INADEQUATE CLEANING |
| EMBODIMENT 4 | 24 | | 0.70 | 0.90 | — | NO | NO |
| EMBODIMENT 5 | 23 | 15° | 0.30 | 2.40 | MARKING AREA'S UPPER SIDE IS SET TO MAKE 15 DEGREE ANGLE TO DIRECTION OF CONDUCTIVE BASE BODY'S CIRCUMFERENCE | NO | NO |
| EMBODIMENT 6 | 23 | 20° | 0.30 | 2.40 | MARKING AREA'S UPPER SIDE IS SET TO MAKE 20 DEGREE ANGLE TO DIRECTION OF CONDUCTIVE BASE BODY'S CIRCUMFERENCE | NO | NO |

Embodiment 7

A conductive base body 2 was made of an aluminum cylinder of an outer diameter of 50 mm, a length of 348 mm and a thickness of 1.0 mm, and received the mirror finish so that its maximum surface roughness did not exceed 0.2 μm. The mirror finish was carried out through a grinding processing by a 30% solvent of "Soluble Tabny Panacool CT" (water-soluble processed oil, made by Idemitu Kosan Co., Ltd.) of a temperature of 8 degrees centigrade. Next, part of the surface of the conductive base body 2 was made rough to provide a marking area 4. To be more specific, a laser beam was applied to a place 18 mm away from one of the ends of the conductive base body 2 to provide the marking area 4. The marking area 4 here was of a square shape with a dimension of 7 mm×7 mm and one side of the square marking area 4 was parallel to a circumference direction of the conductive base body 2. Also, the marking area 4 was located (1) in a contact area with a cleaning blade but (2) out of an image forming area and (3) out of a contact area with a development gap holder. A YAG laser (SL-475G made by NEC Corporation) was used for the above laser beam application at an output of electric current of 18.0 A. Diameter of the dots 9 provided by the laser beam was 200 μm. Distances between the dots 9 shown in FIG. 6, i.e., pitches A and B were both 200 μm. According to a measurement of the conductive base body 2 by a predetermined method, its base body surface roughness was 1.8 μm.

Next, the conductive base body 2 was cleaned by a predetermined method. Then, a lamination type photoconductive layer as an organic photoconductive layer was provided by a dip-for-coating method.

In the cleaning process, the conductive base body 2 was hold upright with the marking area 4 side down, dipped in cleaning liquid 18, 25, 35 and 45 in this order then pulled upward (i.e., in the upward direction parallel to the cylindrical axis of the conductive base body 2). In the coating process, the conductive base body 2 was hold upright with the marking area 4 side down, dipped in coating liquid 6 and then pulled upward (i.e., in the upward direction parallel to the cylindrical axis of the conductive base body 2) from the cleaning liquid 6.

The lamination type photoconductive layer was provided in the following manner. First, 1 part by weight of dibromo anthanthrone (charge producing substance) and 1 part by weight of butyral resin (binder resin, Eslec BM-2 made by Sekisui Chemical Co., Ltd.) were dissolved in 120 parts by weight of cyclohexanone (solvent) and dispersed by a ball mill for 12 hours to prepare the coating liquid (dispersion liquid) 6. Then, the conductive base body 2 was dipped in the prepared coating liquid 6 and pulled up from the coating liquid 6 at a speed of 8 mm/sec to be coated therewith. The coated conductive base body 2 is, finally, dried at a temperature of 80 degrees centigrade for half an hour to be provided with a charge producing layer having a thickness of 0.5 μm.

Next, 1 part by weight of hydrazone charge transporting agent (ABPH made by Nippon Kayaku Co., Ltd.), 1 part by weight of polycarbonate (binder resin, Panlite L-1250 made by Teijin Kasei Co., Ltd.) and 0.00013 part by weight of silicon levelling agent (KF-96 made by Shin-Etsu Chemical Co.,) were added to 8 parts by weight of dichloroethane (solvent). This chemical compound was then heated at 45 degrees centigrade until these three solutes are solved completely, and left to cool down naturally. Second coating liquid 6 was thus obtained. The conductive base body 2 which was already provided with the charge producing layer was dipped in the second coating liquid 6 and pulled up at a pulling-up speed of 8 mm/sec to be coated therewith. Thereafter, the conductive base body 2 was dried at a temperature of 80 degrees centigrade for an hour to be provided with a charge transporting layer. The photosensitive body 1 was thus provided with a photosensitive layer 3 having a thickness of 23 μm.

No liquid sagging 15 was observed by sight inspection with the photosensitive body 1 obtained as above. The photosensitive body 1 was then installed in a copying machine (SF-2118 made by Sharp Corporation), but no particular problem was observed by image inspection. Neither swelling nor falling-off of the photosensitive layer 3 was observed by aging inspection. These results are shown in Table 3.

Comparative Example 3

A comparative photosensitive body 1 was provided by the same manufacturing method as the photosensitive body 1 of the embodiment 7 except a change upon cleaning in a holding direction of a conductive base body 2. Namely, in the cleaning process, the conductive base body 2 of the comparative example 3 was hold upright with a marking area 4 side up, instead of with the marking area 4 side down.

Liquid sagging 15 was observed below the marking area 4 by sight inspection with the comparative photosensitive body 1 obtained as above. The photosensitive body 1 was then installed in a copying machine of the same type as in the embodiment 7 and stain was observed below the marking area 4 by image inspection. Neither swelling nor falling-off of the photosensitive layer 3 was observed by aging inspection. These results are shown in Table 3.

Comparative Example 4

A comparative photosensitive body 1 was provided by the same manufacturing method as the photosensitive body 1 of the embodiment 7 except a change upon coating in a holding direction of a conductive base body 2. Namely, in the coating process, the conductive base body 2 of the comparative example 4 was hold upright with a marking area 4 side up, instead of with the marking area 4 side down.

Liquid sagging 15 was observed below the marking area 4 by sight inspection with the comparative photosensitive body 1 obtained as above. The photosensitive body 1 was then installed in a copying machine of the same type as in the embodiment 7 and stain was observed below the marking area 4 by image inspection. Swelling of the photosensitive layer 3 on the conductive base body 2 was observed by aging inspection after approximately the first 30,000 sheets. Peeling-off of a photosensitive layer 3 from the conductive base body 2 was observed by aging inspection after first 40,000 sheets. These results are shown in Table 3.

Embodiment 8

A marking area 4 was provided by applying the same grinding processing to a conductive base body 2 as the marking area 4 of the embodiment 7 except a change in electric current of the an output to 18.7 A. Diameter of the dots 9 was 200 μm. Distance between the dots 9, i.e., pitches A and B, were both 200 μm. According to a measurement of the conductive base body 2 by a predetermined method, its base body surface roughness was 2.0 μm.

Next, the conductive base body 2 was cleaned by the same method as in the embodiment 7. Then, a lamination type photoconductive layer as an organic photoconductive layer was provided by a same dip-for-coating method as in the embodiment 7 except some changes in compound of coating liquid 6.

The lamination type photoconductive layer was provided in the following manner. First, 6 parts by weight of copolymer nylon resin (CM4000 made by Toray Industries Inc.) was solved in 94 parts by weight of methanol (solvent) to prepare coating liquid 6. The conductive base body 2 was dipped in the prepared coating liquid 6 and pulled up from the coating liquid 6 at a speed of 8 mm/sec to be coated therewith. The coated conductive base body 2 was then dried under the predetermined conditions to be provided with a barrier layer having a thickness of 1.0 μm Secondly, 2 parts by weight of Chlorodianblue (made by Nippon Kayaku Co., Ltd.) and 1 part by weight of polyester (binder resin, Vylon 200 made by Toyobo Co., Ltd.) were solved in 100 parts by weight of ethylenediamine (solvent) and dispersed by a ball mill for 8 hours to prepare second coating liquid 6. The conductive base body 2 which was already provided with the barrier layer was dipped in the second coating liquid 6 and pulled up from the second coating liquid 6 at a pulling-up speed of 8 mm/sec to be coated therewith. Thereafter, the conductive base body 2 was dried at a temperature of 80 degrees centigrade for half an hour to be provided with a charge producing layer having a thickness of 0.4 μm.

Thirdly, 1 part by weight of 1,1-bis(p-diethylaminophenyl)-4,4-diphenyl-1,3-butadiene (butadiene charge transporting agent, made by Takasago Corporation), 1 part by weight of polycarbonate (Panlite L-1225 made by Teijin Kasei Co., Ltd.), 0.00013 part by weight of silicon levelling agent (KF-96 made by Shin-Etsu Chemical Co., Ltd.) were added to 10 part by weight of ethylene chloride (solvent) to prepare third coating liquid 6. The conductive base body 2 above which was already provided with the charge producing layer was dipped in the third coating liquid 6 and pulled up from the third coating liquid 6 at a pulling-up speed of 8 mm/sec to be coated therewith. Thereafter, the conductive base body 2 was dried at a temperature of 80 degrees centigrade for an hour to be provided with a charge transporting layer. The photosensitive body 1 was thus provided a the photosensitive layer 3 having a thickness of 24 μm.

No liquid sagging 15 was observed by sight inspection with the photosensitive body 1 obtained as above. The photosensitive body 1 was then installed in a copying machine of the same type as in the embodiment 7 and no particular problem was observed. Swelling of the photosensitive layer 3 on the conductive base body 2 was observed by aging inspection after approximately first 30,000 sheets. But the swelling was very small and does not cause a problem for actual use. Besides, falling-off of the photosensitive layer 3 from the conductive base body 2 was not observed by aging inspection throughout the lifetime of the photosensitive body 1. These results are shown in FIG. 3.

Comparative Example 5

A comparative photosensitive body 1 was provided by the same manufacturing method as the photosensitive body 1 of the embodiment 8 except a change upon coating in a holding direction of a conductive base body 2. Namely, in the coating process, the conductive base body 2 of the comparative example 5 was hold upright with a marking area 4 side up, instead of with the marking area 4 side down.

Liquid sagging 15 was observed below the marking area 4 by sight inspection with the comparative photosensitive body 1 obtained as above. The photosensitive body 1 was then installed in a copying machine of the same type as in the embodiment 7 and an inadequate image (such as a stained image) was then observed below the marking area 4 by image inspection. Swelling of the photosensitive layer 3 on the conductive base body 2 was observed by aging inspection after approximately first 40,000 sheets. Peeling-off of the photosensitive layer 3 from the conductive base body 2 was observed by aging inspection after first 50,000 sheets. These results are shown in Table 3.

Embodiment 9

A marking area 4 was provided by applying the same grinding processing to a conductive base body 2 of the same type as in the embodiment 7 except that a marking area 4 of the embodiment 9 had an unprocessed part 10 (See FIG. 6). The unprocessed part 10 was provided to be parallel to a direction to pull up the conductive base body 2. Diameter of the dots 9 was 200 μm. Distance between the dots 9, i.e., pitches A and B, were 300 μm and 200 μm respectively. According to a measurement of the conductive base body 2 by a predetermined method, its base body surface roughness was 1.8 μm.

Next, the conductive base body 2 was cleaned by the same method as in the embodiment 7. Then, a lamination type photoconductive layer was provided by the same manufacturing method as in the embodiment 7. A photosensitive body 1 was thus obtained.

No liquid sagging 15 was observed by sight inspection with the comparative photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3.

Embodiment 10

A marking area 4 was provided by applying the same grinding processing to a conductive base body 2 of the same type as in the embodiment 8 except that the marking area 4 of the embodiment 10 had an unprocessed part 10 (See FIG. 6). The unprocessed part 10 was provided to be parallel to a direction to pull up the conductive base body 2. Diameter of the dots 9 was 200 μm. Distances between the dots 9, i.e., pitches A and B, are 300 μm and 200 μm respectively. According to a measurement of the conductive base body 2 by a predetermined method, its base body surface roughness was 1.8 μm.

Next, the conductive base body 2 was cleaned by the same method as in the embodiment 8. Then, a lamination type photoconductive layer was provided by the same manufacturing method as in the embodiment 8. A photosensitive body 1 was thus obtained.

No liquid sagging 15 was observed by sight inspection with the comparative photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3.

Embodiment 11

A marking area 4 was provided by applying the same grinding processing to a conductive base body 2 as the marking area 4 of the embodiment 10 except that the marking area 4 of the embodiment 11 had an unprocessed part 10 (See FIG. 7). The unprocessed part 10 was provided to be tilting to a direction to pull up the conductive base body 2. Diameter of the dots 9 was 200 μm. Distances between the dots 9, i.e., pitches A' and B', are 400 μm and 200 μm respectively. According to a measurement of the conductive base body 2 by a predetermined method, its base body surface roughness was 1.5 μm.

Next, the conductive base body 2 was cleaned by the same method as in the embodiment 10. Then, a lamination type photoconductive layer was provided by the same manufacturing method as in the embodiment 10. A photosensitive body 1 was thus obtained.

No liquid sagging 15 was observed by sight inspection with the comparative photosensitive body 1 obtained as above. The photosensitive body 1 was then installed in a copying machine of the same type as in the embodiment 7 and no particular problem was observed. Neither swelling nor falling-off of the photosensitive layer 3 was not observed by aging inspection. These results are shown in Table 3.

Embodiment 12

A marking area 4 was provided by applying the same grinding processing to a conductive base body 2 as the marking area 4 of the embodiment 9 except that the marking area 4 of the embodiment 12 had a carved groove 51. The carved groove 51 was provided 200 μm away from a lower end of the marking area 4 with respect to the conductive base body 2 hold in a upright position (or, in other words, the word "lower" here refers to the opposite direction to a direction to pull up the conductive base body 2). Besides, the carved groove 51 had a dimension of 200 μm in width, 7 mm in length and 30.0 μm in depth, and was provided by a laser beam at electric current of 18.0 A at the same time when the marking area 4 was provided. According to a measurement of the conductive base body 2 by a predetermined method, its base body surface roughness was 1.8 μm.

Next, the conductive base body 2 was cleaned by the same method as in the embodiment 9. Then, a lamination type photoconductive layer was provided by the same manufacturing method as in the embodiment 9. A photosensitive body 1 was thus obtained.

No liquid sagging 15 was observed by sight inspection with the comparative photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3. Moreover, in the embodiments 7 and 9, a slight irregularity in thickness was observed by sight inspection although the irregularity causes no problem in actual use. In the embodiment 12, irregularity in thickness was even smaller and coating condition was better than in the embodiments 7 and 9. Besides, a tact time was shortened further.

Embodiment 13

A marking area 4 was provided by applying the same grinding processing to a conductive base body 2 as the marking area 4 of the embodiment 12 except that a carved groove 51 of the embodiment 13 was carved to a side of the conductive base body 2. In other words, carved grooves 52 were further provided in order to link the ends of the carved groove 51 in the marking area 4 to the side of the conductive base body 2 (see FIG. 9). According to a measurement of the conductive base body 2 by a predetermined method, its base body surface roughness was 1.8 μm.

Next, the conductive base body 2 was cleaned by the same method as in the embodiment 12. Then, a lamination type photoconductive layer was provided by the same manufacturing method as in the embodiment 12. A photosensitive body 1 was thus obtained.

No liquid sagging 15 was observed by sight inspection with the photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3.

Moreover, in the embodiment 13, irregularity in thickness was even smaller and coating condition was better than in the embodiment 12. Besides, the tact time was shortened even further.

Embodiment 14

A photosensitive body 1 was provided by the same manufacturing method as the photosensitive body 1 of the embodiment 7 except some changes in coating. Namely, in the coating process, a conductive base body 2 of the embodiment 14 was hold upright with a marking area 4 side up, instead of with the marking area 4 side down. Also, the conductive base body 2 was pulled up from coating liquid 6 at a speed of 8 mm/sec until a lower side of the marking area 4 comes to a surface of the coating liquid 6. The conductive base body 2 was then stopped for 1 second with the lower side of the marking area 4 right at the surface of the coating liquid 6, and pulled up again at a speed of 8 mm/sec to be coated therewith.

No liquid sagging 15 was observed by sight inspection with the photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3.

Embodiment 15

A photosensitive body 1 was provided by the same manufacturing method as the photosensitive body 1 of the embodiment 8 except some changes in coating. Namely, in the coating process, a conductive base body 2 of the embodiment 15 was hold upright with a marking area 4 side up, instead of with the marking area 4 side down. Also, the conductive base body 2 was pulled up from coating liquid 6 at a speed of 8 mm/sec until a lower side of the marking area 4 comes to a surface of the coating liquid 6. The conductive base body 2 was then stopped for 1 second with the lower side of the marking area 4 right at the surface of the coating liquid 6, and pulled up again at a speed of 8 mm/sec to be coated therewith.

No liquid sagging 15 was observed by sight inspection with the photosensitive body 1 obtained as above. The photosensitive body 1 was then installed in a copying machine of the same type as in the embodiment 7 and no particular problem was observed. Neither swelling nor falling-off of the photosensitive layer 3 was observed by aging inspection. These results are shown in Table 3.

TABLE 3

| | Marking area was above/ below image forming area | | Processing conditions of conductive base body | | | | | |
|---|---|---|---|---|---|---|---|---|
| | clea-ning | coat-ing | Pitch A (μm) | Pitch B (μm) | Base body surface roughness (μm) | Inadequat cleaning/ coating *E | *I | Adhesive Strength |
| Embodiment 7 | below | below | 200 | 200 | 1.8 | G | G | G |
| Comparative example 3 | above | below | 200 | 200 | 1.8 | G | NG | G |
| Comparative example 4 | below | above | 200 | 200 | 1.8 | NG | NG | NG |
| Embodiment 8 | below | below | 200 | 200 | 2.0 | G | G | S |
| Comparative example 5 | below | above | 200 | 200 | 2.0 | NG | NG | NG |
| Embodiment 9 | below | below | 300 | 200 | 1.8 | G | G | G |
| Embodiment 10 | below | below | 300 | 200 | 1.8 | G | G | G |
| Embodiment 11 | below | below | 400 | 200 | 1.5 | G | G | G |
| Embodiment 12 | below | below | 300 | 200 | 1.8 | G | G | G |
| Embodiment 13 | below | below | 300 | 200 | 1.8 | G | G | G |
| Embodiment 14 | below | above | 200 | 200 | 1.8 | G | G | G |
| Embodiment 15 | below | above | 200 | 200 | 2.0 | G | G | G |

Note: Inadequate cleaning/coating

*E: Eye inspection.

G: Good. No sagging was observed.

NG: Not good. Sagging happened.

*I: Image inspection.

G: Good. No problem.

NG: Not good. Inadequate image (such as stain) observed.

Adhesive strength

G: Good. No swelling nor falling-off was observed.

S: Swelling was observed to the extent of posing no problem in actual use.

NG: No good. Swelling and falling-off from the photosensitive body were observed.

As clear from Table 2, if the coating film surface roughness was specified not to exceed 2.5 μm and the SN value was specified to be in the range of 0.3 to 0.7, the photosensitive body 1 installed in an electrophotographic device such as a copying machine did not cause the problems such as inadequate cleaning and toner failing. In other words, since the photosensitive body 1 was provided with coated film surface roughness of not more than 2.5 μm, and SN value in the range of 0.3 to 0.7, the photosensitive body 1 had an excellent ability: namely, even if the photosensitive layer 3 thereof was thin, the thin photosensitive layer 3 did not cause the problems such as inadequate cleaning and toner falling.

As clear from the results of the embodiment 3 and the comparative example 2, it was possible to improve the surface characteristics such as the smoothness of the photosensitive layer 3 by a surface treatment of the photosensitive layer 3. The surface treatment was carried out through annealing in the manufacturing process of the photosensitive body 1 in accordance with various conditions such as film thickness.

Here refers to a case where (1) in the coating process, the conductive base body 2 was hold upright with the marking area 4 side down, dipped in the coating liquid 6 and then pulled upward (i.e., in the upward direction parallel to the cylindrical axis of the conductive base body 2) from the coating liquid 6, and also (2) the upper side of the marking area 4 was provided not to be parallel to the circumference direction of the conductive base body 2. In this case, as clearly shown in the results of the embodiments 5 and 6, the upper side of the marking area 4 made it possible to prevent the liquid sagging 15 during providing the photosensitive layer 3.

Here refers to a case where, in the cleaning process or the coating process by the coating liquid 6, the conductive base body 2 was hold upright so that the marking area 4 side was below the image forming area. As clear from the results of the embodiments 7 and 8, and the comparative examples 3, 4 and 5 in Table 3, in this case, it was possible to prevent inadequate image such as the liquid sagging 15 and the stained image. And in this case, it was also possible to prevent the photoconductive layer 3 from swelling and falling off from the conductive base body 2, and therefore to maintain the good adhesive strength.

Here refers to a case where the marking area 4 was provided to have the continuous unprocessed part 10 not orthogonal to the pulling-up direction of the conductive base body 2, or in other words, parallel or diagonal to the cylindrical axis of the conductive base body 2. As clear from the results of the embodiments 9, 10 and 11 in the Table 3, or to be more specific, as understood from comparison between the embodiments 8 and 10, or comparison between the embodiments 8 and 11, in this case, it was possible to further prevent the inadequate image such as the liquid sagging 15 and the stained image. And in this case, it was also possible to prevent the photoconductive layer 3 from swelling and falling off from the conductive base body 2, and therefore to maintain the good adhesive strength.

Here refers to a case where the marking area 4 was provided with the carved groove 51 which was orthogonal to the pulling-up direction of the conductive base body 2. As clear from the embodiment 12, in this case, it was possible to restrain the irregular thickness and thus to maintain the coating state even better. In this case, it was also possible to shorten the tact time.

Here refers to a case where the carved grooves 52 are provided to extend from the carved groove 51 to the side of the conductive base body 2. As clear from the embodiment 13, in this case, it was possible to further restrain the irregular thickness and thus to maintain the coating state even better. In this case, it was also possible to even further shorten the tact time.

Here refers to a case where (1) in the coating process, the conductive base body 2 was hold upright with the marking area 4 side up, or in other words, the conductive base body 2 was hold upright so that the marking area 4 was above the image forming area, and also (2) the speed to pull up the conductive base body 2 from the coating liquid 6 was changed while the conductive base body 2 was being pulled up. As shown in the embodiments 14 and 15, in this case, the change in the pulling-up speed made it possible to prevent the inadequate image such as the liquid sagging 15 and the stained image. And in this case, it was also possible to prevent the photoconductive layer 3 from swelling and falling off from the conductive base body 2, and therefore to maintain the good adhesive strength.

It should be understood that the detailed description and specific examples, while indicating the preferred embodiments as above in accordance with the present invention, are given by way of illustration only. The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing a photosensitive body for electrophotosensitive use, comprising the steps of:

(1) preparing a conductive base body having a first surface part and a second surface part, the second surface part having optical reflective characteristics different from those of the first surface part, and being provided outside an image forming area; and (2) providing a photosensitive layer on the conductive base body by applying a photosensitive liquid, wherein, in the step (2), the conductive base body is held so that the second surface part is below the image forming area with respect to a gravity direction.

2. The manufacturing method as defined in claim 1, further comprises the step of cleaning the conductive base body, wherein, in the step, the conductive base body is held so that the second surface part is below the image forming area with respect to a gravity direction.

3. A method of manufacturing a photosensitive body for electrophotographical use, comprising the steps of:

(1) preparing a conductive base body having a first surface part and a second surface part, the second surface part having optical reflective characteristics different from those of the first surface part, the second surface part further including an unprocessed part continuously extending in a first direction not orthogonal to a gravity direction; and (2) providing a photosensitive layer on the conductive base body by applying photosensitive liquid while excessive amount of the photosensitive liquid flows down along the unprocessed part.

4. The manufacturing method as defined in claim 3, wherein the unprocessed part is provided to be parallel to the gravity direction of the conductive base body.

5. The manufacturing method as defined in claim 3, wherein the unprocessed part is provided to be diagonal to the gravity direction of the conductive base body.

6. The manufacturing method as defined in claim 3, wherein the second surface part is provided by applying a laser beam to the first surface part.

7. The manufacturing method as defined in claim 3, wherein the unprocessed part is provided by providing processed parts including lines of cavities having the optical reflective characteristics different from those of the first surface part so that each processed part is separated from each other and extends in the first direction.

* * * * *